US007562975B2

(12) United States Patent
Yokoyama et al.

(10) Patent No.: US 7,562,975 B2
(45) Date of Patent: Jul. 21, 2009

(54) POSITIONING STRUCTURE OF IMAGE FORMING APPARATUS

(75) Inventors: Noriko Yokoyama, Tokyo (JP); Hiroshi Hashi, Tokyo (JP)

(73) Assignee: Olympus Corporation, Tokyo (JP)

( * ) Notice: Subject to any disclaimer, the term of this patent is extended or adjusted under 35 U.S.C. 154(b) by 365 days.

(21) Appl. No.: 11/345,943

(22) Filed: Feb. 2, 2006

(65) Prior Publication Data

US 2006/0170751 A1 Aug. 3, 2006

(30) Foreign Application Priority Data

Feb. 3, 2005 (JP) ..... 2005-027824

(51) Int. Cl.
*B41J 2/01* (2006.01)

(52) U.S. Cl. ..... 347/104; 347/8; 347/32; 347/33; 347/85; 347/86; 346/134

(58) Field of Classification Search ..... None
See application file for complete search history.

(56) References Cited

U.S. PATENT DOCUMENTS 4,620,807 A * 11/1986 Polit ..... 400/56
5,246,224 A 9/1993 Matsuno et al.
5,274,399 A * 12/1993 Uchida et al. ..... 346/134
6,910,766 B2 * 6/2005 Haug ..... 347/104
7,152,971 B2 * 12/2006 Kumagai et al. ..... 347/104
7,325,895 B2 * 2/2008 Nakashima ..... 347/8

FOREIGN PATENT DOCUMENTS

JP 2731963 B2 12/1997
JP 2003094744 A * 4/2003
JP 2004-161477 A 6/2004

OTHER PUBLICATIONS

Derwent Publication: English Abstract of JP2003094744A 2001 JP-294476 Filing Date Sep. 26, 2001, Publication Date Apr. 3, 2003.*

* cited by examiner

*Primary Examiner*—Matthew Luu
*Assistant Examiner*—John P Zimmermann
(74) *Attorney, Agent, or Firm*—Frishauf, Holtz, Goodman & Chick, P.C.

(57) ABSTRACT

A positioning structure of an image forming apparatus comprises an image recording medium to be transported; an ink head unit for ejecting ink fluids onto the image recording medium; a transport mechanism for transporting the image recording medium; a recording unit for retaining the ink head unit; an apparatus body frame for retaining at least the recording unit and the transport mechanism; a transport roller for introducing the image recording medium to the transport mechanism by regulating a transport position of the image recording medium; a restrict unit, being installed in the recording unit and the transport mechanism, for restricting a positional interrelationship between the recording unit and the transport mechanism; and an elevator mechanism for making a gap between the recording unit and transport mechanism changed, wherein the recording unit is retained by the apparatus body frame and/or the transport mechanism at three points.

8 Claims, 21 Drawing Sheets

POSITIONING STRUCTURE OF IMAGE FORMING APPARATUS

CROSS REFERENCE TO RELATED APPLICATION

This application is based upon and claims the benefit of priority from the prior Japanese Application No. 2005-27824, filed Feb. 3, 2005, the entire contents of which are incorporated herein by reference.

BACKGROUND OF THE INVENTION

1. Field of the Invention

The present invention relates to a positioning structure of an image forming apparatus.

2. Description of the Related Art

Conventionally known is an image forming apparatus for forming a color image on a image recording medium by a plurality of ink head groups ejecting respective color ink fluids, i.e., black (K), cyan (C), magenta (M) and yellow (Y), onto the image recording medium.

Such an image forming apparatus equips itself with a transport mechanism for transporting an image recording medium, which is commonly called a belt platen, and a recording unit equipped with four respective color ink head group which are fixed at a predetermined interval in the transport direction of the image recording medium and above the aforementioned belt platen for ejecting the respective color ink fluids, i.e., black (K), cyan (C), magenta (M) and yellow (Y) as noted above.

A configuration is such that the belt platen is an endless band belt, is spanned between a drive roller and a driven roller, is placed with an application of a tension from the lower inside part of the belt by using a tension roller which also has the function as belt walk adjustment mechanism and is set to move rotationally in a prescribed moving direction by the driving rotation of a drive roller and the driven rotation of a driven roller.

The above described platen belt brings in an image recording medium and also transports the aforementioned image recording medium toward the downstream of a plurality of ink head groups along with the movement of the belt while suction-holding the image recording medium. The ink head group ejects ink on the image recording medium transported downstream for forming an image. The image recording medium forming the image thereon is then transported by the belt platen for exiting to the outside of the apparatus.

Such an image forming apparatus is configured to equip itself with a common reference part for the belt platen and recording unit in the main body of the apparatus so as to position the belt platen and recording unit by making them respectively contact with the reference part (e.g., refer to a laid-open Japanese patent application publication No. 2004-161477.) Also known is an image forming apparatus for forming a toner image on an image recording medium a lá sheet of paper transported by a belt platen by a recording unit of an electrophotography system.

Such an image forming apparatus is configured to equip itself with a roller pair (called a "registration roller pair" hereinafter) on the carry-in side of an image recording medium of the belt platen (i.e., the upstream side of the transport direction of an image recording medium) for stopping temporarily to stop transporting the image recording medium supplied from a paper supply apparatus and resuming a rotation synchronously with the image forming timing to introduce the image recording medium to the belt platen in order to regulate and correct an inclination of the image recording medium in the direction of transportation (e.g., skew) and synchronize with an image forming timing of the recording unit.

Such an image forming apparatus is capable of carrying an image recording medium whose transported position is corrected by the registration roller pair into the belt platen in a correct transported position and suctioning the image recording medium onto the belt by a suction force of the belt platen.

Then, the recording unit transfers a toner image onto the image recording medium transported by the belt platen, a fusing apparatus fuses the toner image on the image recording medium by transporting the image recording medium which has been transferred with the toner image into the fusing apparatus, and the exit roller pair succeeds the transportation for ejecting to the outside of the image forming apparatus (e.g., refer to a Japanese registered patent No. 2731963).

Incidentally, while the recording unit of the above noted Japanese registered patent No. 2731963 comprises only one photoreceptor, what exists also, however, is a tandem type electrophotographic image forming apparatus in which four photoreceptors for black (K), cyan (C), magenta (M) and yellow (Y) are serially placed a lá multiple stages in a predetermined interval along the transport direction. The difference between these two are the numbers of photoreceptors, one versus four, otherwise the other configurations are almost the same.

By the way, in order to accomplish a high accuracy image quality, a transport direction of an image recording medium regulated for direction (i.e., a skew is corrected) by the registration roller pair matches with a transport direction of the image recording medium by the belt platen, and also nozzle rows of a ink head group (which is the rotation shaft of a photoreceptor body in an electrophotographic image forming apparatus) are installed respectively in parallel with one another in the direction perpendicular to the transport direction of the image recording medium, thereby securing a printing accuracy.

Otherwise, if the above described positional relationship is not stable in other words, a displacement among each color pixel occurs so as to bring about a color shift in a formed image in overlapping four colors being formed on the image recording medium, thus resulting in failing to secure a high accuracy printing.

A cause for such an unstable positional relationship or a displaced one among the registration roller pair, belt platen and recording unit includes the fact that a distortion in the apparatus body frame occurs when moving the image forming apparatus during transportation for example, causing a distortion in the positional interrelationship among the registration roller pair, belt platen and recording unit, resulting in the transport direction of the image recording medium by the belt platen shifting or the position of the ink head group (that is the position of a photoreceptor in an electrophotographic image forming apparatus) which is fixed onto the recording unit shifting vis-à-vis the transport direction of the image recording medium by the belt platen.

Either of the above noted reference documents, however, does not disclose a comprisal, mechanism, method, et cetera, for the purpose of reducing an influence of a distortion of an apparatus body frame to a positional interrelationship among the registration roller pair, belt platen and recording unit as much as possible, nor is there a description as to suggest any.

SUMMARY OF THE INVENTION

A positioning structure of an image forming apparatus according to the present invention comprises an image recording medium to be transported; an ink head unit for ejecting ink fluids onto the image recording medium; a transport mechanism for transporting the image recording medium; a recording unit for retaining the ink head unit and also positioning itself opposite the transport mechanism; an apparatus body frame for at least the recording unit and the transport mechanism; a transport roller for introducing the image recording medium to the transport mechanism by regulating a transport position of the image recording medium; a restrict unit, being installed in the recording unit and the transport mechanism, for restricting a positional interrelationship between the recording unit and the transport mechanism; and a elevator mechanism for making a gap between the recording unit and transport mechanism changed, wherein the recording unit is retained by the apparatus body frame and/or the transport mechanism at three points.

DESCRIPTION OF THE PREFERRED EMBODIMENTS

First Embodiment

<Comprisal>

The following description is of the first embodiment of the present invention while referring to the above noted FIGS. 1 through 6.

Figure 1:
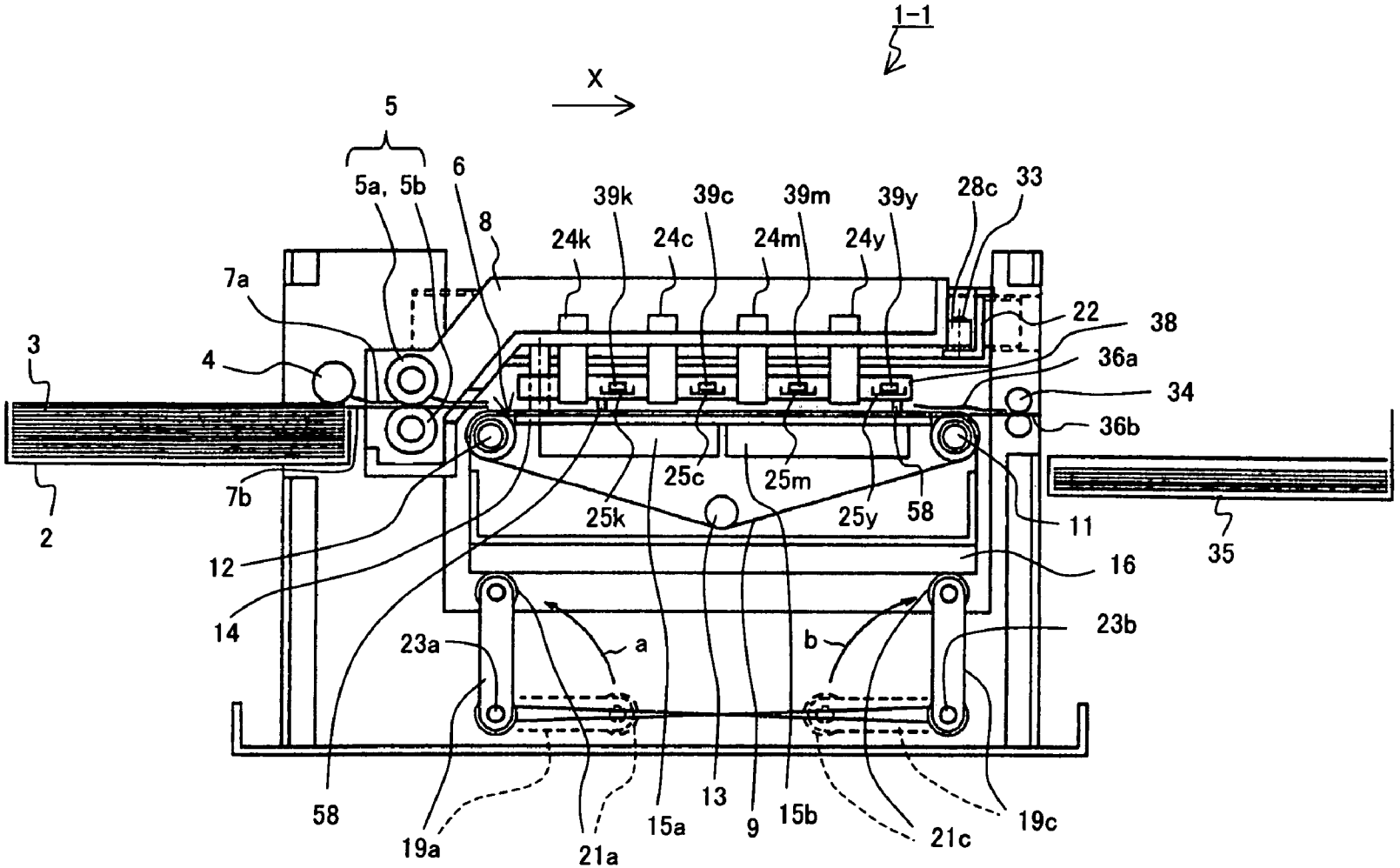
FIG. 1 is a side view of an image forming apparatus according to a first embodiment.

As shown by FIG. 1, an image forming apparatus 1-1 (also simply called an "apparatus" hereinafter) is detachably attached by a paper feed tray 2 on one side (i.e., the left side in the case of FIG. 1) thereof. The paper feed tray 2 is stacked and housed by a large number of cut sheets (also simply called a "paper" hereinafter) 3 as image recording media. The paper feed edge part of the paper feed tray 2 (i.e., the edge part on the right side in FIG. 1) is equipped by a pickup roller 4 which is configured to feed a cut sheet 3 housed in the paper feed tray 2 to the inside of the apparatus body sheet by sheet.

A registration roller pair 5 (i.e., 5*a* and 5*b*) is placed as a transport roller on the extension line of a transport path of the cut sheet 3 which is supplied from the pickup roller 4 into the inside of the apparatus body.

Figure 4:
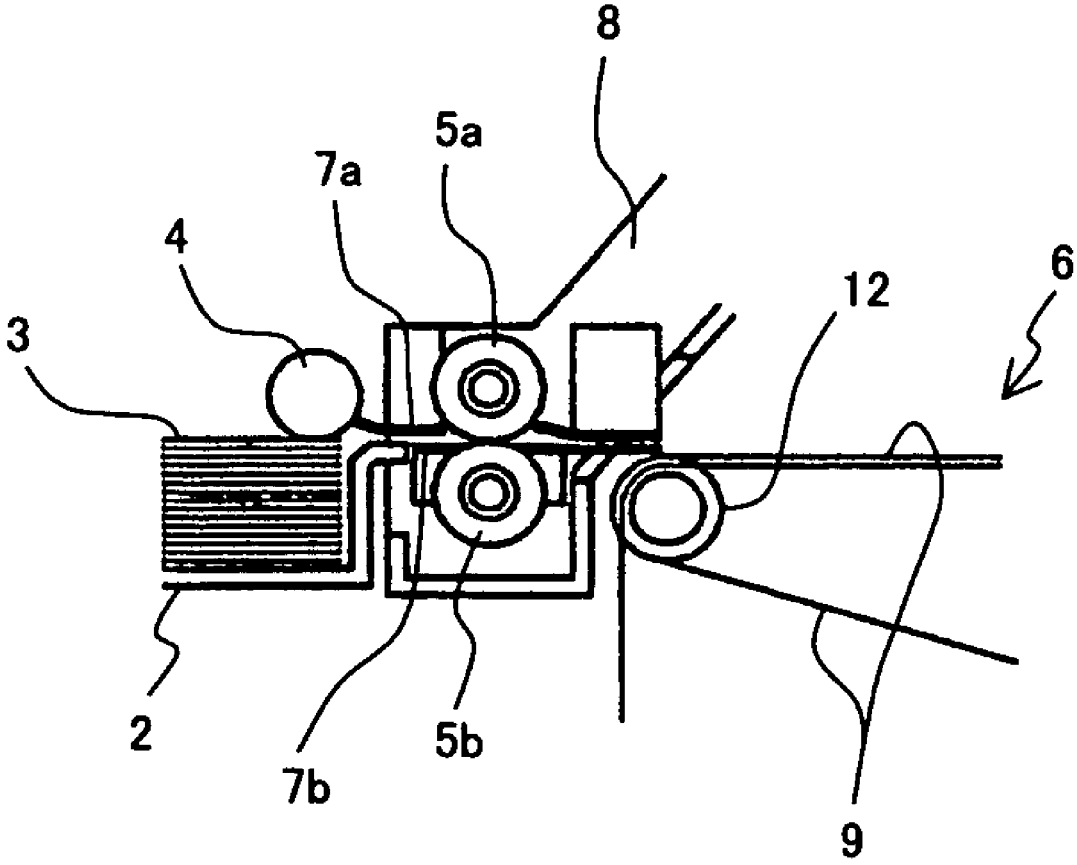
FIG. 4 is a detailed diagram showing a relationship between a paper feed unit and registration roller pair of an image forming apparatus according to the first embodiment.

The registration roller pair 5 is placed in such a manner that the upper surface of the lower registration roller 5*b* is approximately on the same plane as the extension line of the transport path of the paper 3 as shown by FIG. 4.

On the registration roller 5*b* is installed, in parallel therewith, by a registration roller 5*a* which is pressed onto the registration roller 5*b* forced by a spring (not shown herein).

An upper registration unit guide 7*a* and a lower registration unit guide 7*b* are placed by facing with each other in the up and down direction across the upstream and downstream of the paper transport direction of the registration roller pair 5.

These upper registration unit guide 7*a* and lower registration unit guide 7*b* are placed keeping the distance suitable for the cut sheet 3 passing between the aforementioned two guides.

The upper registration unit guide 7*a* and the lower registration unit guide 7*b* lead, to the registration roller pair 5, the cut sheet 3 which is transported from the pickup roller 4, and further lead it from the registration roller pair 5 to a belt platen 6.

This feeds the cut sheet 3 from the pickup roller 4 to the registration roller pair 5 in a stable condition in the up and down directions, followed by the cut sheet 3 being forcibly corrected to a right transported position for a skew, et cetera, by the registration roller pair 5.

The upper registration unit guide 7*a* and the lower registration unit guide 7*b* are fixed to a head frame 8 shown by FIGS. 1 and 4, and the registration roller pair 5 is likewise and rotationally fixed to the head frame 8.

Figure 2:
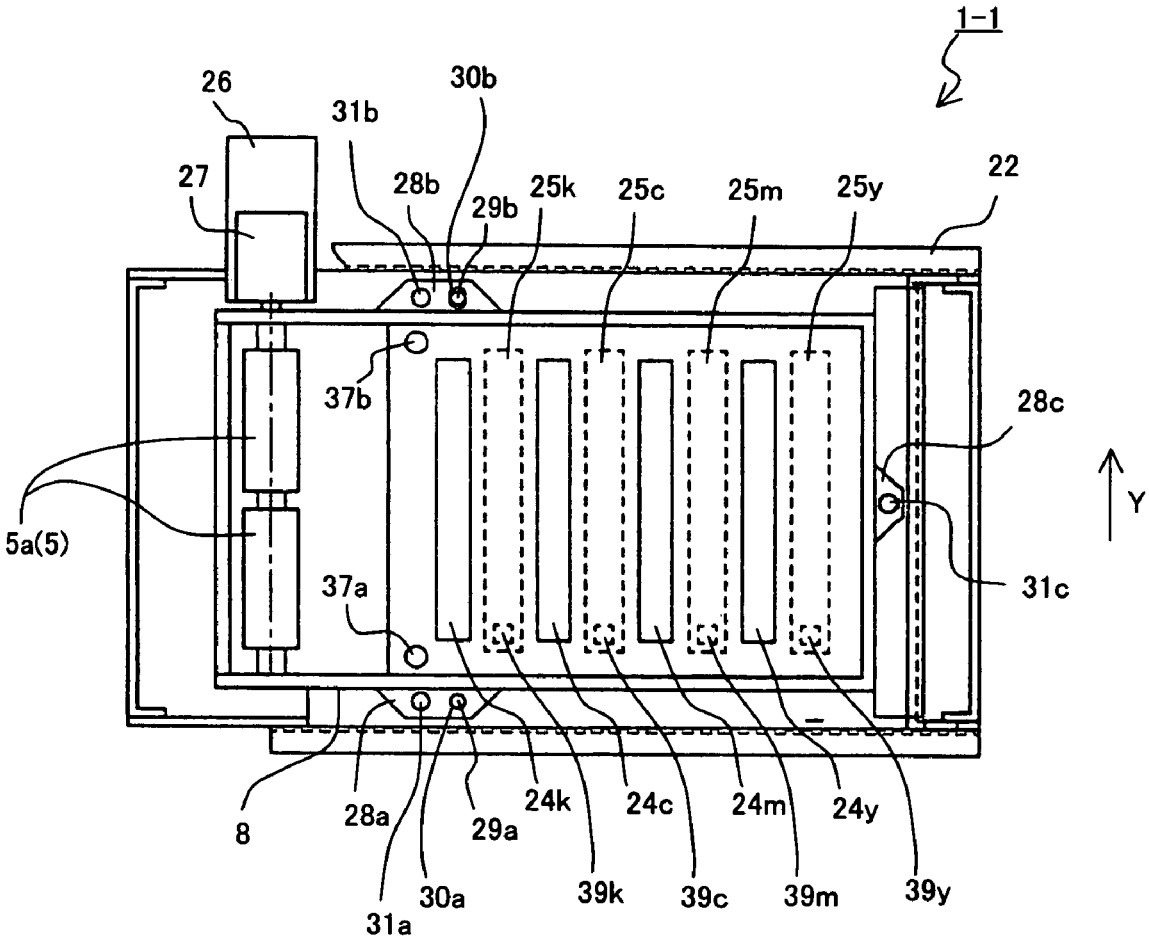
FIG. 2 is a plain view of an image forming apparatus according to the first embodiment.
Figure 3:
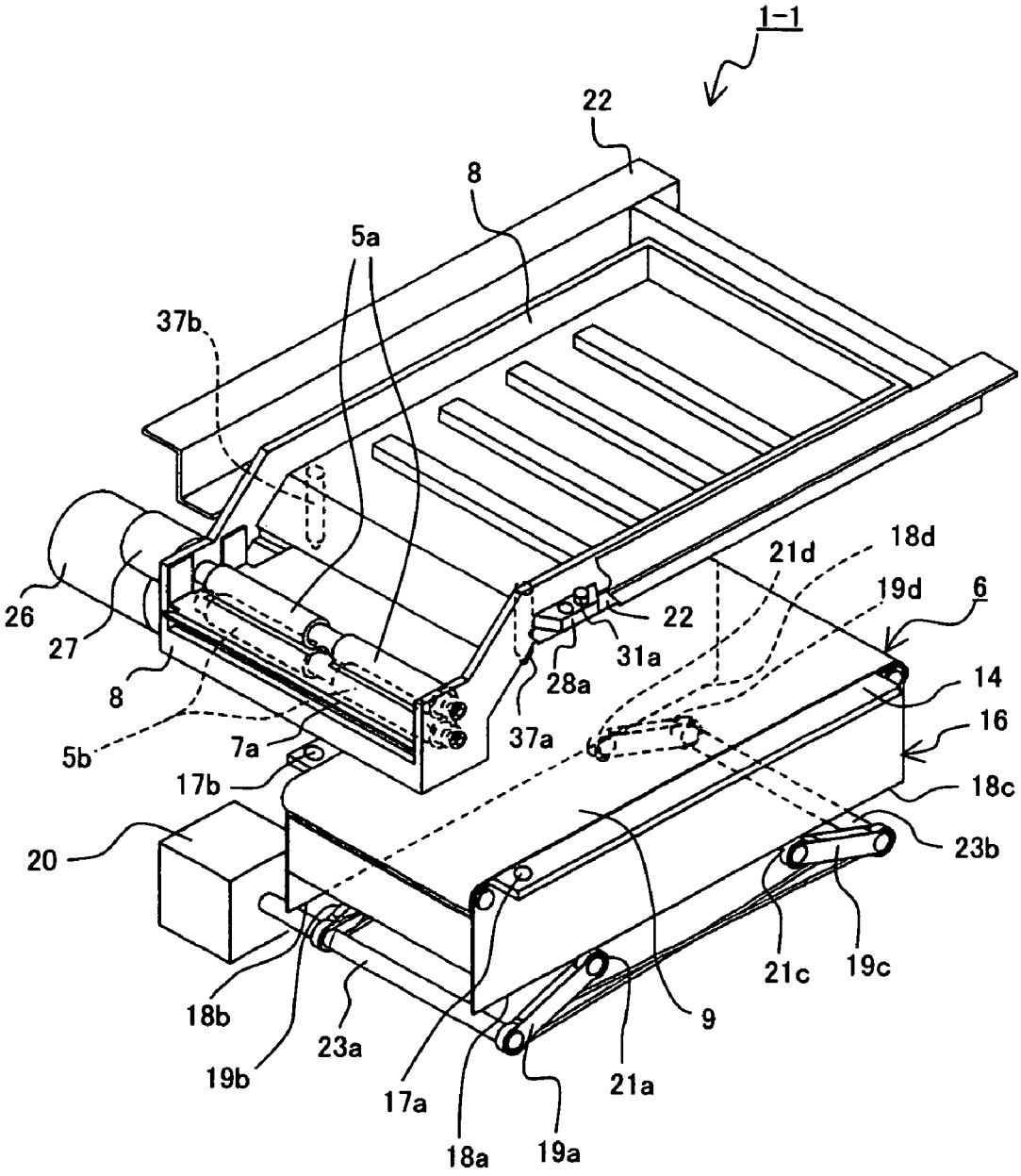
FIG. 3 is a diagonal view showing a head unit as a recording unit separated, from a belt platen, of an image forming apparatus according to the first embodiment.

A registration motor 26 is connected on one end of the registration roller 5*b*, as shown by FIGS. 2 and 3, for rotating it.

And a registration clutch 27 is connected to the end of the registration roller 5*a* which is driven under the control thereof for rotation and stop.

Meanwhile, a belt 9, drive roller 11, driven roller 12, tension roller 13, platen 14, suction fans 15*a* and 15*b*, all shown by FIG. 1, are mounted onto a platen frame 16 to integrally constitute the above described belt platen 6.

The belt 9 is an endless band belt featured by an uncounted number of holes and is spanned between the drive roller 11 and driven roller 12.

The tension roller 13 is placed on the inside of the belt 9 at approximately the center of the lower circulation part of the belt 9. The tension roller 13 biases the lower circulation part of the belt 9 by pushing outward. This makes the belt 9 spanned, with a tension, between the above noted three rollers.

In this state, the belt 9 forms a paper transport surface in the upper circulation part between the drive roller 11 and the driven roller 12. The above described platen 14 is a plate member featuring an uncounted number of holes and is installed along the inside of the belt of the paper transport surface of the belt 9. And the suction fans 15*a* and 15*b* are placed underneath the platen 14.

The platen 14 is processed so as to have a predetermined flatness for preventing a cut sheet 3 from snaking its way and is fixed to a platen frame 16 in a state of maintaining the flatness. The drive roller 11 and the driven roller 12 are retained at the respective both ends rotationally so as to be parallel with each other by a processing accuracy of the platen frame 16.

The tension roller 13 provides the belt 9 with tension and also is retained by the platen frame 16 in the state capable of adjusting a walk of the belt 9 (i.e., moving either to left or right directions rectangular to the moving direction of the belt 9) by an adjustment mechanism (not shown herein).

As shown by FIG. 3, the platen 14 is featured by positioning holes 17*a* and 17*b* for restricting positions of the head frame 8 and belt platen 6. The positioning holes 17*a* and 17*b* are featured on both ends of the upstream side of the paper transport direction of the platen 14, with the one positioning hole 17*a* being featured by a circle and the other positioning hole 17*b* being featured by an elongate hole extending in the direction perpendicular to the paper transport direction. Meanwhile, lower edges 18 (i.e., 18*a*, 18*b*, 18*c* and 18*d*) formed under the platen frame 16 of the belt platen 6 are contacted by four rollers 21 (i.e., 21*a*, 21*b*, 21*c* and 21*d*).

The four rollers 21 (i.e., 21*a*, 21*b*, 21*c* and 21*d*) are respectively installed at the end of four elevator arms 19 (i.e., 19*a*, 19*b*, 19*c* and 19*d*) as an elevator mechanism for moving the belt platen 6 up and down directions. The elevator arms 19*a* and 19*b* are retained by an arm shaft 23*a* which is rotationally retained by the apparatus body frame 22. The elevator arms 19*c* and 19*d* also retained by an arm shaft 23*b* which is rotationally retained by the apparatus body frame 22.

The arm shaft 23*a* is connected to an elevator drive source 20 and the arm shaft 23*b* is configured to rotate in the reverse direction by synchronously linking with the arm shaft 23*a* by way of a drive transmission system (not shown herein).

As the arm shafts 23*a* and 23*b* synchronously rotate in the respective directions of the arrow "a" and arrow "b" as shown by FIG. 1, the four elevator arms 19 moves rotationally from the horizontal position shown by the dotted lines to the vertical position shown by the solid lines, both shown by FIG. 1, while having the respective rollers 21 be in a sliding contact with the lower edges 18 (refer to FIG. 18) of the platen frame 16. This moves the belt platen up.

Then, as the arm shafts 23*a* and 23*b* synchronously rotate in the respective directions opposite to the arrow "a" and arrow "b" starting from the above described state, the four elevator arms 19 moves rotationally from the vertical position shown by the solid lines to the horizontal position shown by the dotted lines, both shown by FIG. 1, while having the respective rollers 21 be in a sliding contact with the lower edges 18 of the platen frame 16. This moves the belt platen down.

Note that, when the above described four elevator arms 19 become the upright state by moving to the vertical positions, the positions of the belt platen 6 of the positioning holes 17*a* and 17*b* is set up for the ones for forming an image by transporting a cut sheet 3 by suctioning onto the upper surface of the belt platen 6 (i.e., the upper circulation part of the belt 9).

Also, this position is set at the one where the upper surface of the belt platen 6 is the same position as, or a lower position than, the upper surface of the registration roller 5*b*.

The above described head frame 8 is installed above the belt platen 6 as shown by FIGS. 1 and 3.

The head frame 8 fixedly retains a plurality of individual color ink heads, i.e., ink heads 24*k*, 24*c*, 24*m* and 24*y*, for respectively ejecting the individual colors, i.e., black, cyan, magenta and yellow, in the aforementioned sequence, respectively parallel with the direction vertical to the transport direction of the belt 9 and in a predetermined interval in the transport direction of the belt 9 as shown by FIGS. 1 and 2.

These ink heads 24*k*, 24*c*, 24*m* and 24*y* are placed at the predetermined interval being equidistance and also forming distances allowing placing respective ink pans 25*k*, 25*c*, 25*m* and 25*y* in the respective spaces between the ink heads 24*k*, 24*c*, 24*m* and 24*y*.

The above described head frame 8 and ink heads 24*k*, 24*c*, 24*m* and 24*y* constitute a recording unit which is placed in a position opposite the transport surface (i.e., the upper circulation part of the belt 9) of the belt platen 6 which is formed as a transport mechanism.

As described before, the four elevator arms 19 as an elevator mechanism makes the gap between the recording unit and transport mechanism changed in the up and down direction, for which the entirety is set up so that the position of the belt platen 6 and the position of the ink heads 24*k*, 24*c*, 24*m* and 24*y* at the time of the four elevator arms 19 being in the upright state by moving to the vertical position are in a right distance for the purpose of forming an image correctly on the cut sheet 3 placed on the belt platen 6 by ink droplets ejected from the ink fluid ejection surface (i.e., the bottom surface in FIG. 1) of the ink heads 24*k*, 24*c*, 24*m* and 24*y*.

Note that the above described registration roller pair 5 is retained by the head frame 8 in parallel with the longitudinal direction of the above described ink heads 24*k*, 24*c*, 24*m* and 24*y* as shown by FIG. 2.

A shown by FIG. 2, a total of three fixing parts 28 (i.e., 28*a*, 28*b* and 28*c*) are featured on the sides (i.e., the side and the rear side) of the head frame 8 as the fixing units for the purpose of positioning the head frame 8 to the apparatus body frame 22.

Incidentally, FIG. 1 shows only the fixing part 28*c* for a cross sectional view, while FIG. 3 does not allow a viewing of the fixing parts 28*b* or 28*c* which is behind other parts.

Among these three fixing parts 28, the fixing part 28*a* is featured by a circular fit hole (round hole) 30*a* for fitting with a positioning boss 29 (i.e., 29*a*) which is fixedly inserted into the apparatus body frame 22 and further featured by a through screw hole 31*a* on the side of the fit hole 30*a*.

And the fixing part 28*b* is featured by a fit hole (elongated hole) 30*b* having a elongation in the direction perpendicular to the paper transport direction for the purpose of inserting a positioning boss 29 (i.e., 29*b*) which is fixedly inserted into the apparatus body frame 22 and further featured by a through screw hole 31*b* on the side of the fit hole 30*b*.

These positioning bosses 29 (i.e., 29*a* and 29*b*) fit with the fit holes 30 (i.e., the circular hole 30*a* and the elongated hole 30*b*) for fitting with the positioning bosses 29, respectively, so as to position the head frame 8 against the apparatus body frame 22.

Figure 6:
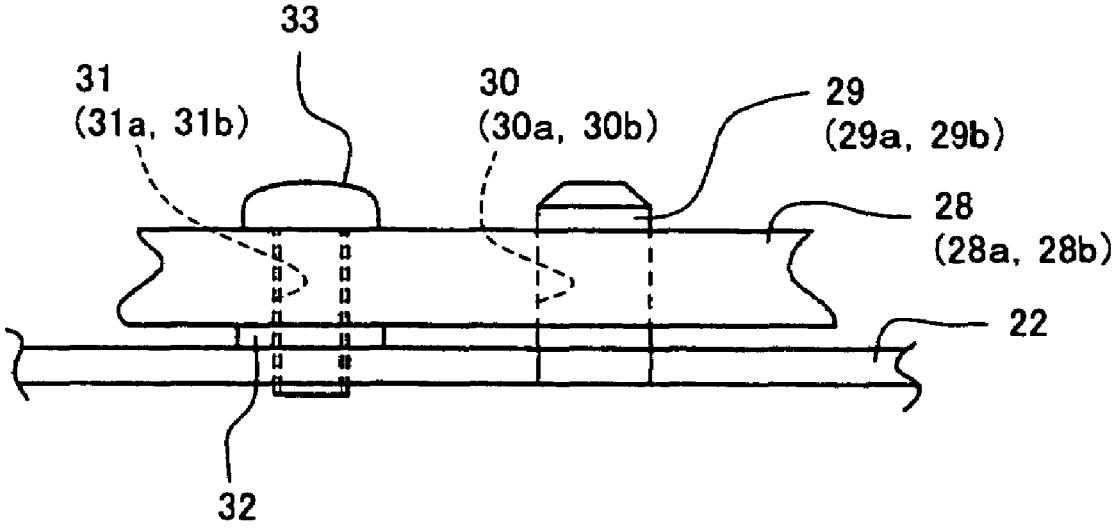
FIG. 6 is an enlarged diagram showing details of a positioning & fixing unit of a head frame and apparatus body frame of an image forming apparatus according to the first embodiment.

FIG. 6 is an enlarged diagram showing the details of the above described positioning & fixing unit of the head frame 8 and apparatus body frame 22.

As shown by FIG. 6, the positioning boss 29 of the apparatus body frame 22 first inserts itself into the fit hole 30 of the fixing unit of the head frame 8, thereby positioning the head frame 8 against the apparatus body frame 22.

Prior to the above, the apparatus body frame 22 is featured by a circular contact part 32 in advance at a position corresponding to the through screw hole 31 of the fixing part 28.

The contact part 32 may be formed integrally with the apparatus body frame 22 or the fixing part 28, or may be sandwiched between the apparatus body frame 22 and the fixing part 28 of the head frame 8 a lá washer at the time of the above described positioning.

In either the case, the apparatus body frame 22 and the head frame 8 which are positioned as described above are fixed by fastening a screw 33 by way of a small area contact of the contact part 32.

Note that the fixing part 28*c* seen in FIGS. 1 and 2 comprises only a through screw hole 31 (i.e., 31*c*), in lieu of a fit hole as shown by FIG. 2, thereby being fixed to the apparatus body frame 22 by fastening a screw 33 shown by FIG. 6 by intervening the contact part 32 in the same way as described above, while not specifically shown herein.

As described above, the head frame 8 is fixed at two points by making the side close to the registration roller pair 5 (i.e., in the upstream of the paper transport direction) contacted with the contact part 32 of the apparatus body frame 22 respectively by the fixing parts 28*a* and 28*b*, and fixed by the fixing members such as the screws 33.

Furthermore, the head frame 8 is fixed at one point by making the side far from the registration roller pair (i.e., in the downstream of the paper transport direction) likewise contacted with the contact part 32 of the apparatus body frame 22 by the fixing part 28*c*, and fixed by the fixing member such as the screw 33.

And the contact between the apparatus body frame 22 and the head frame 8 at the above described fixing part 28*c* is carried out by the circular contact part 32, which is configured to minimize the contact surface as small as possible.

Note that the present embodiment is configured in such a manner that the apparatus body frame 22 and the head frame 8 contact at three circular contact units 32 having very small area sizes as compared to the sizes of the apparatus body frame 22 and head frame 8.

While the three circular contact units 32 are not "points" in a strict sense, the present embodiment calls them points because the three circular contact units 32 have very small area sizes as compared to the sizes of the apparatus body frame 22 and head frame 8. The contact part 32 may of course be featured as another form having a very small area size in lieu of a circular form, or may be a hemisphere with a center being displaced from the screw 33 for making it a point contact. Furthermore, each of the three contact units may be configured as a plurality of surfaces or points with very small area sizes.

Note that the fixing parts 28 (i.e., 28*a*, 28*b* and 28*c*) are configured to have a rigidity capable of enduring a total weight of the head frame 8 and the attached respective parts.

As described above, the head frame 8, that is, the recording unit, is fixed at three points of small contact areas with the engaging parts of apparatus body frame 22, that is, is supported thereby at three points.

This configuration reduces a possibility of causing an ill effect such as a large distortion to the head frame 8, that is, the recording unit, even if a distortion in the apparatus body frame 22 occurs by a circumstantial condition such as a logistics and transportation unlike such cases of fixing rigidly by four or six points.

Therefore, there is hardly a possibility of a distortion occurring in a mutual positional relationship among a plurality of ink head group which is highly accurately fixed onto the recording unit, hence eliminating a possibility of appearing an ill effect on the printing accuracy.

Now continuing description of FIG. 1, an exit roller pair 34, an upper exit paper guide 36*a* and lower exit paper guide 36*b*, which are opposite from each other in the up and down direction, are placed in the paper transport path in the downstream of the belt 9.

The upper exit paper guide 36*a* and lower exit paper guide 36*b* lead a cut sheet 3 transported from the belt 9 to the exit paper tray 35 therefrom by way of the exit roller pair 34.

And the upper exit paper guide 36*a* and lower exit paper guide 36*b* are placed keeping a distance suitable for a cut sheet 3 passing through between them. And the cut sheet 3 exiting from the exit roller pair 34 is stacked and housed in the exit paper tray 35.

Moreover, positioning pins 37*a* and 37*b* are fixed onto the lower surface of the head frame 8 downward on both ends toward the registration roller pair 5 as shown by FIG. 3. These positioning pins 37*a* and 37*b* are installed in the positions opposite the positioning holes 17*a* and 17*b* featured on the platen 14.

When the belt platen 6 is lifted upward to be positioned at the image forming position by the above described elevator arms 19*a*, 19*b*, 19*c* and 19*d* moving to the vertical position by being rotationally driven, the positioning pins 37*a* and 37*b* respectively fit with the positioning holes 17*a* and 17*b*, thereby positioning the head frame 8 and the platen 14.

That is, the above described positioning pins 37*a* and 37*b*, and the positioning holes 17*a* and 17*b*, are configured as a restrict unit for restricting a mutual positional relationship between the head frame 8 as the recording unit and the platen 14 as the transport mechanism.

Note that, although two positioning pins 37*a* and 37*b* are placed at both ends toward the registration roller pair 5, that is, on the upstream side of the transport direction for the purpose of positioning the head frame 8 with the belt platen 6, the two positioning pins 37*a* and 37*b* may be placed on one end part of the upstream and downstream sides of the transport direction.

Incidentally, a maintenance unit 38 is installed between the head frame 8 and the belt platen 6. The maintenance unit 38 is retained by the apparatus body frame 22 movably in the up and down directions.

The maintenance unit 38, being arrayed corresponding to the ink heads 24*k*, 24*c*, 24*m* and 24*y*, is equipped by the above described ink pans 25*k*, 25*c*, 25*m* and 25*y* which have the function of ink catchers, and an X direction drive mechanism (not shown herein) for driving the aforementioned ink pans 25*k*, 25*c*, 25*m* and 25*y* in the x-positive and x-negative directions.

Figure 5:
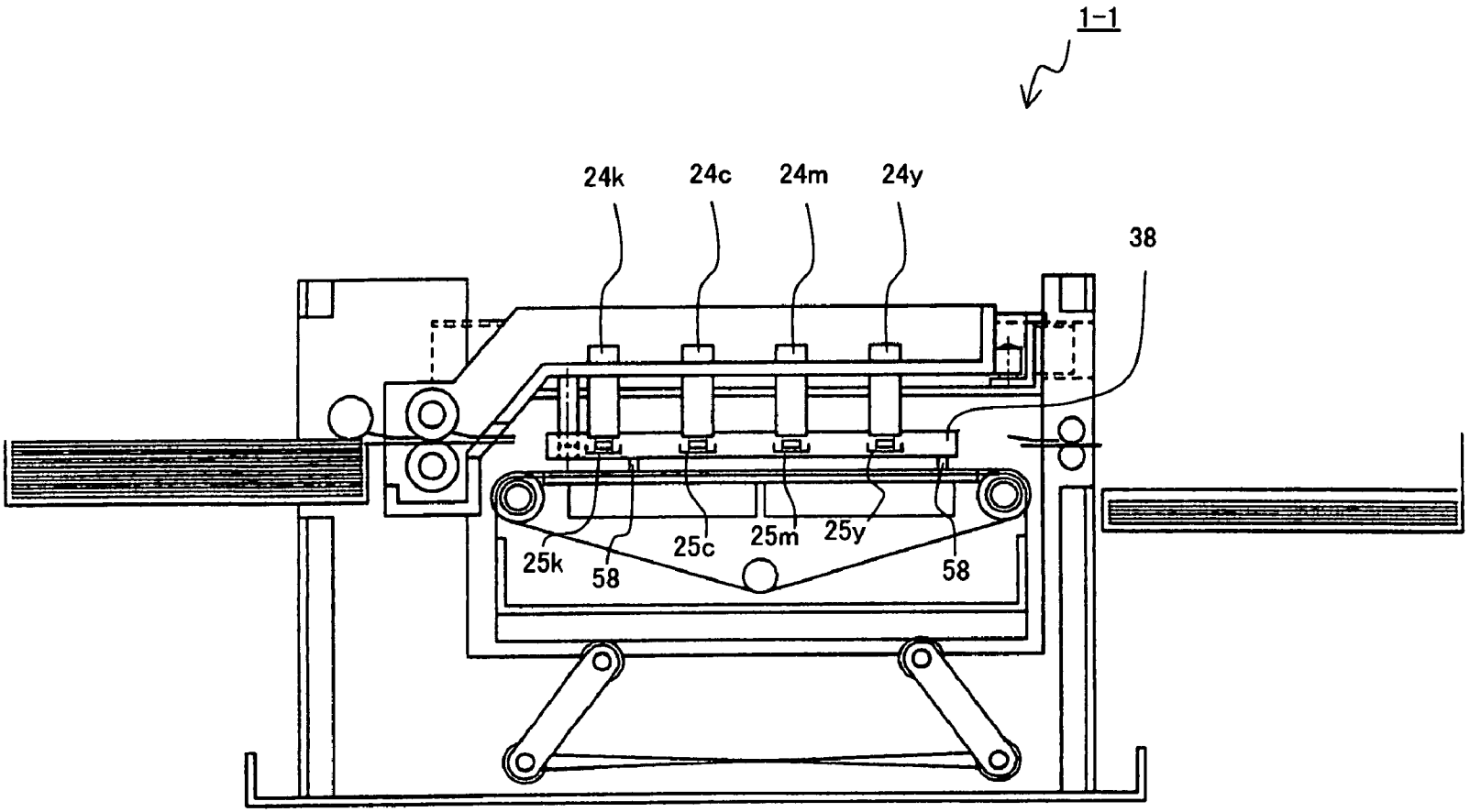
FIG. 5 is a side view at the time of recovery by a head recovery mechanism of an image forming apparatus according to the first embodiment.

The ink pans 25*k*, 25*c*, 25*m* and 25*y* are controlled by the X direction drive mechanism (not shown herein) so as to move to the cleaning position which is the position opposite the lower parts of the ink heads 24*k*, 24*c*, 24*m* and 24*y* shown by FIG. 5, and a retract position which retracts the ink pans 25*k*, 25*c*, 25*m* and 25*y* between each of the ink heads 24*k*, 24*c*, 24*m* and 24*y* at the time of the ink heads 24*k*, 24*c*, 24*m* and 24*y* respectively ejecting inks onto the cut sheet 3.

The maintenance unit 38 per se rides on the platen 14 which extends toward the outside in the width direction of the belt 9 of the belt platen 6 by three or more unit pins 58, shown by FIGS. 1 and 5, which are fixed onto the bottom surface of the maintenance unit 38, thus constituting a mechanism for moving up and down following the belt platen 6 as a result of the belt platen moving up and down.

In the inside of the ink pans 25*k*, 25*c*, 25*m* and 25*y*, suction nozzles 39*k*, 39*c*, 39*m* and 39*y* having suction apertures for suctioning inks as shown by FIGS. 1 and 2 (component numbers are omitted in FIG. 5) are installed so as to be able to contact with the ink heads 24*k*, 24*c*, 24*m* and 24*y* respectively, and are movable in the y-positive and y-negative directions along the ink ejecting aperture row of the ink heads 24*k*, 24*c*, 24*m* and 24*y* by a Y direction drive mechanism (not shown herein).

Incidentally, the suction nozzles 39*k*, 39*c*, 39*m* and 39*y* are connected by a suction force generation source (not shown herein) for carrying out a maintenance to eliminate a failure such as an ink clogging by suctioning the ink ejection apertures of the ink heads 24*k*, 24*c*, 24*m* and 24*y*.

<Operation>

The next description is of an operation of the image forming apparatus 1-1 comprising as described above.

First, the power is input and a restrict unit (not shown herein) of the image forming apparatus 1-1 makes the belt platen 6 moved down by driving the elevator arms 19*a*, 19*b*, 19*c* and 19*d* and makes the X direction drive mechanism (not shown herein) of the maintenance unit 38 move the ink pans 25*k*, 25*c*, 25*m* and 25*y* to the position opposite the lower part of the ink heads 24*k*, 24*c*, 24*m* and 24*y* at the time of a stand-by of the image forming apparatus 1-1.

By this, if there is ever ink spilling out of the ink heads 24*k*, 24*c*, 24*m* or 24*y*, the spilled-out ink is caught by the ink pans 25*k*, 25*c*, 25*m* and 25*y*, thus preventing the apparatus interior from being contaminated.

Next, as an instruction for image forming is input from a operator panel (not shown herein) of the image forming apparatus 1-1, or an instruction signal for forming an image is input from the host equipment (not shown herein) connected by a signal line, the above described restrict unit of the image forming apparatus 1-1 makes the above described X direction drive mechanism of the maintenance unit 38 move the ink pans 25*k*, 25*c*, 25*m* and 25*y* to the retract position where the ink pans 25*k*, 25*c*, 25*m* and 25*y* are placed between the ink heads 24*k*, 24*c*, 24*m* or 24*y*.

Then, makes the elevator arms 19*a*, 19*b*, 19*c* and 19*d*, which are rotationally and synchronously driven in the directions of "a" and "b", elevate the belt platen 6 until the elevator arms 19*a*, 19*b*, 19*c* and 19*d* become the vertical state, thereby setting the gap between the ink heads 24*k*, 24*c*, 24*m* and 24*y* and the belt platen 6 at a predetermined printing suitable distance.

In this event, the positioning pins 37*a* and 37*b* fixed onto the lower surface of the head frame 8 fit with the positioning holes 17*a* and 17*b* featured in the platen 14, thereby positioning between the head frame and belt platen 6.

And a parallelism of the registration roller pair 5 and ink heads 24*k*, 24*c*, 24*m* and 24*y* is secured by the respective mounting accuracies, and therefore the above described positioning eventually secures the accuracies of the belt platen 6, registration roller pair 5 and the ink heads 24*k*, 24*c*, 24*m* and 24*y*.

Then, the registration roller pair 5, drive roller 11 and exit roller pair 34 are driven, followed by the pickup roller 4 being driven.

By this, one sheet of the cut sheet 3 on top of the stack is fed out of the paper feed tray 2 by the pickup roller 4, and the cut sheet 3 is sent out to the gap between the upper registration unit guide 7*a* and the lower registration unit guide 7*b* on the upstream side of the registration roller pair 5 in the cut sheet transport direction.

The cut sheet 3 passes the guide unit while being guided by these upper registration unit guide 7*a* and lower registration unit guide 7*b*, followed by reaching at a holding part formed by an opposing part between the registration rollers 5*a* and 5*b* of the registration roller pair 5.

In this event, while the registration roller 5*b* rotates, the registration roller 5*a* is temporarily stopped rotating by the registration clutch 27.

By this, the cut sheet 3 transported toward the registration roller pair 5 runs into the holding part and is restrained for a transported position by being temporarily stopped progressing by the registration roller 5*a*. That is, a skew is corrected if there is one.

Then, a rotation stop by the registration clutch 27 is released after a predetermined time so that the registration roller 5*a* resumes a rotation driven by the registration roller 5*b*.

By this, the cut sheet 3 passes the gap between the upper registration unit guide 7*a* and the lower registration unit guide 7*b*, by being guided thereby, on the downstream side of the registration roller pair 5 in the paper transport direction, and is fed out onto the belt 9 of the belt platen 6 at a predetermined speed.

A suction power by the suction fans 15*a* and 15*b* is provided onto the belt 9 by way of uncounted numbers of holes featured in the platen 14 and belt 9.

The cut sheet 3 sent out from the registration roller pair 5 onto the belt 9 is transported in the x-direction at a prescribed transport speed in the state of being suctioned by the above described suction force onto the belt 9 which moves in circulation in the clock wise (CW) direction (as shown by FIG. 1 for example) by the rotations of the drive roller 11 that is rotationally driven by a drive source (not shown herein) and driven roller 12 that is driven by the drive roller 11.

Then, the cut sheet 3 transported by the belt 9 of the belt platen 6 is transported to the underneath of the respective ink heads 24*k*, 24*c*, 24*m* and 24*y* which are mounted and placed on the head frame 8 corresponding to the respective colors, i.e., black (K), cyan (C), magenta (M) and yellow (Y).

Then, ink droplets are ejected from the above described ink heads 24*k*, 24*c*, 24*m* and 24*y* onto the cut sheet 3 at the timing thereof arriving at the image forming position, thereby recording an image on the cut sheet 3.

Then, the cut sheet 3 recorded by the respective colors being overlapped is guided by the gap between the upper exit paper guide 36*a* and the lower exit paper guide 36*b*, ejected to the outside of the apparatus by the exit roller pair 34 and housed in stack within the exit paper tray 35.

Incidentally, a non-uniform image may occur in an image formed on the cut sheet 3 if the transport direction change thereof occurs when the cut sheet 3 is handed over from the registration roller pair 5 to the belt platen 6.

For example, focusing on an overlapped image of black and yellow printed by the ink head 24*k* and ink head 24*y*, there is a possibility of the two colors overlapping with each other differently between the leading edge and trailing edge of the cut sheet 3.

This is a non-uniform image caused by the fact that the transport direction of the cut sheet 3 being transported by the registration roller pair 5 does not match with the transport direction of the belt platen 6.

Such a non-uniform image, if it is recognized, can be eliminated by a correcting work of correcting the transport direction of the belt 9 by adjusting the tension roller 13 of the belt platen 6 by an adjustment mechanism (not shown herein) and making the transport direction by the registration roller pair 5 and that by the belt platen 6 matched with each other.

However, even if a high image quality is obtained at the time of assembly and testing by making the transport direction by the registration roller pair 5 and that by the belt platen 6 matched with each other in the production factory, a failure in obtaining such a high image quality may occur in an installation site of a customer, if an individual positional accuracy becomes out of line caused by a logistics and transportation, et cetera, after being delivered from the factory. The cause is largely an influence of a distortion of the apparatus body frame 22 during a logistics and transportation.

The present invention is configured such that the registration roller pair 5 is retained by the head frame 8 mounting the ink heads 24*k*, 24*c*, 24*m* and 24*y*, in lieu of being retained by the apparatus body frame 22.

Therefore, even if a distortion occurs in the apparatus body frame 22, positional accuracies of the registration roller pair 5 and ink heads 24*k*, 24*c*, 24*m* and 24*y*, which are retained by the head frame 8, are not influenced.

Meanwhile, the belt platen 6 is mounted by the elevator arms 19*a*, 19*b*, 19*c* and 19*d* driven by the arm shafts 23*a* and 23*b* whose respective end parts are retained by the apparatus body frame 22. That is, the belt platen 6 is just placed on the elevator arms 19*a*, 19*b*, 19*c* and 19*d*, in lieu of being fixed thereto.

Therefore, the belt platen 6 moves on the respective rollers 21*a*, 21*b*, 21*c* and 21*d* compliant to the fit of the positioning pins 37*a* and 37*b*, which are fixed onto the head frame 8, and positioning holes 17*a* and 17*b* which are featured in the platen 14.

By this, the head frame 8 and the belt platen 6 are directly positioned so as to secure both positional accuracy.

The above described positioning secures the positional accuracy of the belt platen 6 against the registration roller pair 5 and ink heads 24*k*, 24*c*, 24*m* and 24*y* which are mounted on the head frame 8.

On the other hand, the head frame 8 is directly fixed to the apparatus body frame 22 so as to be influenced thereby, the fixing method, however, is by three points as above described and the three points are configured by small contact areas as much as possible and therefore a distortion of the apparatus body frame 22 influencing the head frame 8 becomes small.

Therefore, if a distortion occurs in the apparatus body frame 22 caused by a logistics and transportation, et cetera, the positional accuracy of each of the head frame 8, belt platen 6, registration roller pair 5 and ink heads 24*k*, 24*c*, 24*m* and 24*y* is maintained.

By this, the transport accuracy of the cut sheet 3 vis-à-vis the ink heads 24*k*, 24*c*, 24*m* and 24*y* is maintained, hence making it possible to provide a high image quality image forming apparatus.

Second Embodiment

<Comprisal>

The next description is of a second embodiment according to the present invention while referring to FIGS. 7 through 11. Note that the same comprisal part as the above described first embodiment is shown by assigning the same component number as the first embodiment where a description is deemed as necessary for the second embodiment, while an assignment of component number and a description are omitted where a description is deemed as unnecessary for the second embodiment, in the drawings used for the following description.

The first description is of a transport unit. An image forming apparatus 1-2 according to the second embodiment is configured so that the platen 14 equips itself with positioning arms 41 (i.e., 41*a* and 41*b*) for restricting the positions of the head frame 8 and the belt platen 6 as shown by FIGS. 7 through 10.

Figure 7:
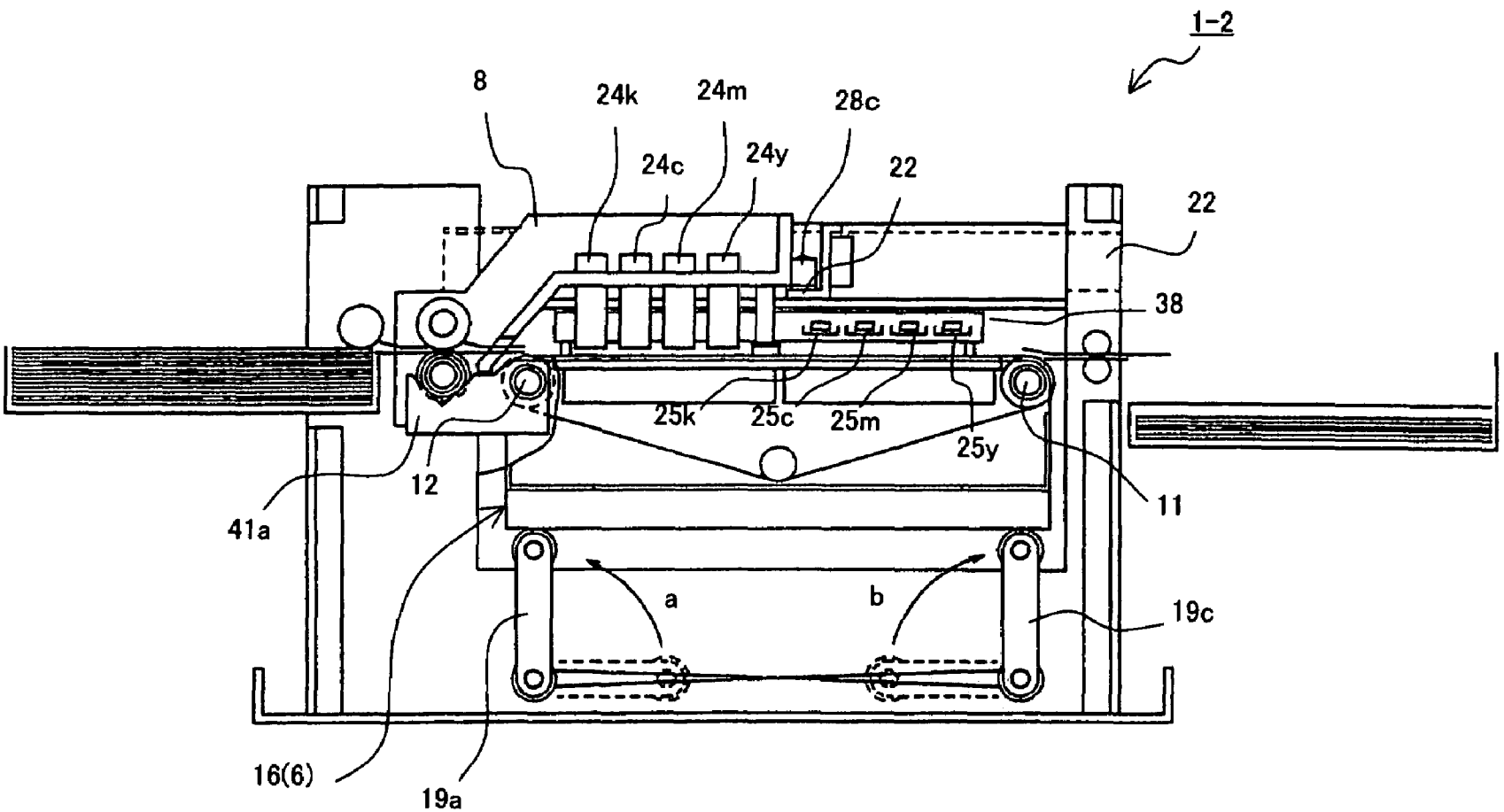
FIG. 7 is a side view of an image forming apparatus according to a second embodiment.
Figure 9:
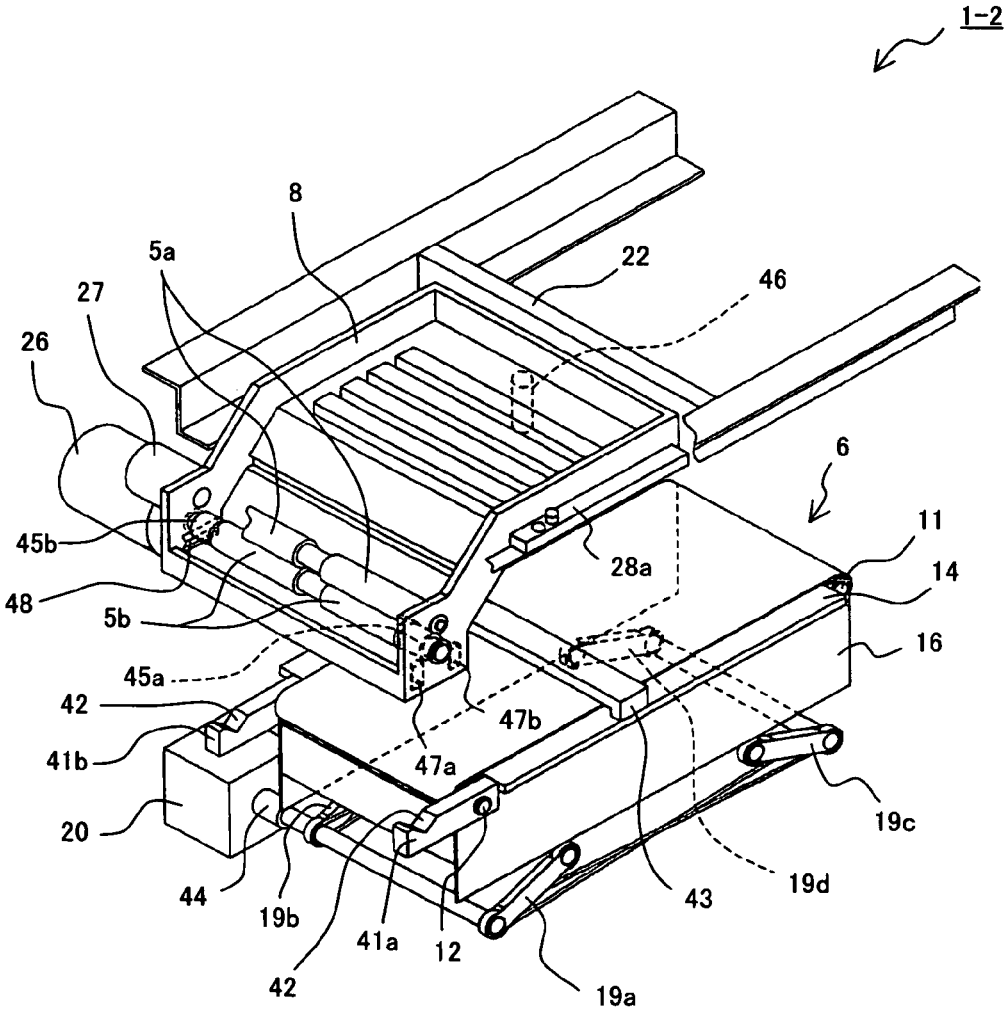
FIG. 9 is a diagonal view showing a head unit as a recording unit separated, from a belt platen, of an image forming apparatus according to the second embodiment.

The rear end side of each the positioning arms 41 (on the downstream side in the paper transport direction) is rotationally fit with the shaft of the driven roller 12 and is positionally fixed to the platen frame 16 (refer to FIGS. 7 and 9).

Figure 10:
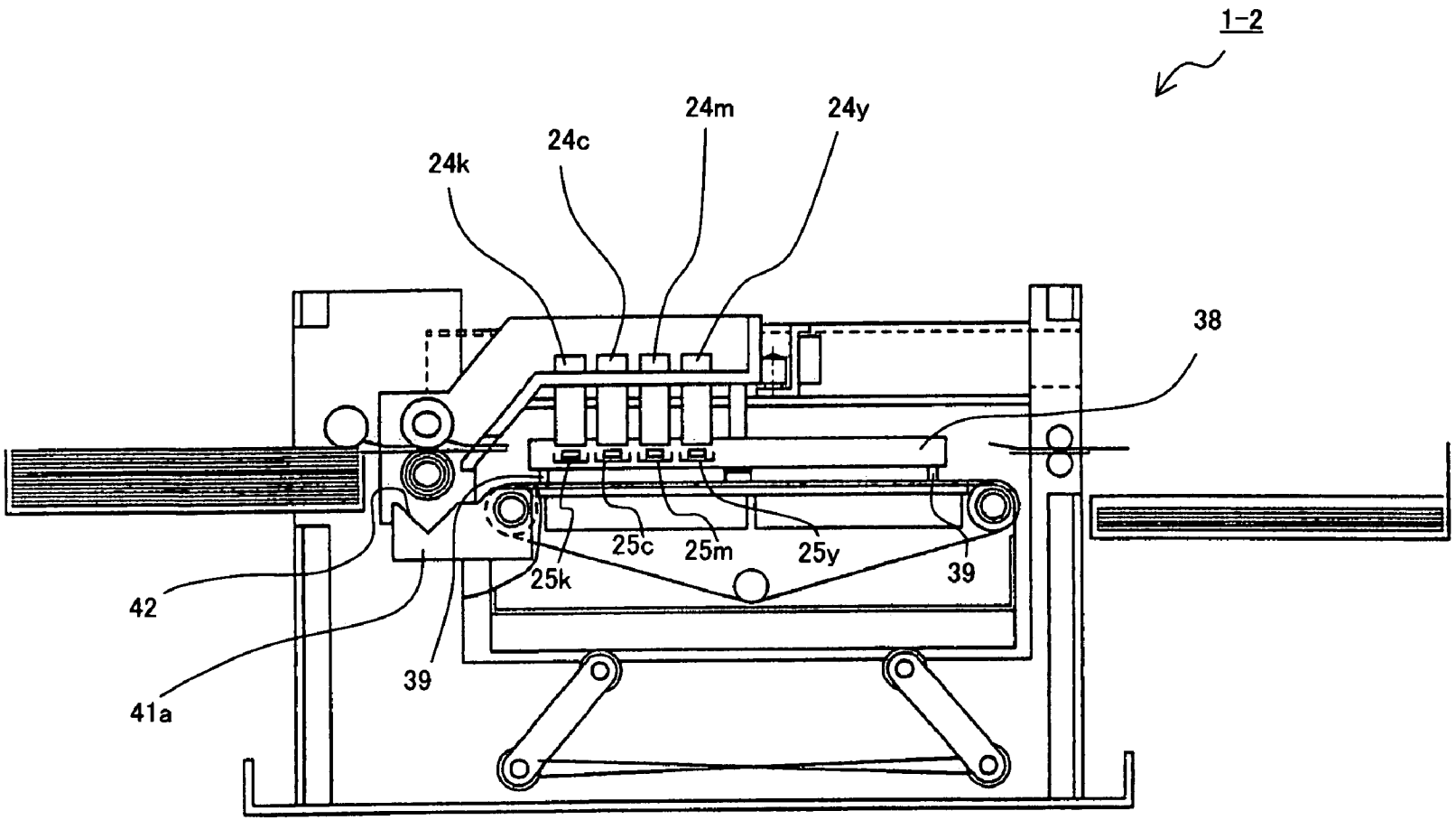
FIG. 10 is a side view at the time of recovery by a head recovery mechanism of an image forming apparatus according to the second embodiment.

And the free end side of each of the positioning arms 41 is featured by a notch part 42 whose cross section is a lá V, extending toward the head frame 8 (refer to FIGS. 9 and 10).

And at the approximate center of the belt platen 6 in the cut sheet transport direction is fixed by a tie bar 43 on the platen 14 in the state of keeping distance of no less than 5 mm from the belt 9 so as not to hamper a passing of the cut sheet 3 on the belt 9 (refer to FIG. 9).

The comprisal of the elevator arms 19*a*, 19*b*, 19*c* and 19*d* moving the belt platen 6 and platen frame 16 up and down (refer to FIGS. 7 and 9) is the same as the case of the first embodiment.

Except that the present embodiment is configured to connect a torque limiter 44 on the arm shaft 23*a* which rotationally drives the elevator arms 19*a* and 19*b* in addition to the elevator drive source 20.

The torque limiter 44 is set up for activating when a larger load than a usual torque for lifting the belt platen 6 is loaded on the arm shaft 23*a*.

Next, the head frame 8 of the present embodiment which is installed above the belt platen 6 is mounted by the respective color ink heads 24*k*, 24*c*, 24*m* and 24*y* at the smallest possible interval in the sequence of the respective colors (K, C, M and Y), respectively parallel with the direction perpendicular to the cut sheet transport direction of the belt 9, and on the upstream side of the belt 9 in the cut sheet transport direction.

Note that the comprisal of the paper feed system and transport system for the cut sheet 3 vis-à-vis the belt platen 6 shown by FIGS. 7 through 10 is the same as the paper feed tray 2, pickup roller 4, upper and lower registration unit guides 7*a* and 7*b*, registration roller pair 5, et cetera which are shown by FIG. 1, while assigning component numbers are omitted.

The present embodiment is also configured to feature a total of three fixing parts 28 (i.e., 28*a*, 28*b* and 28*c* on the side surfaces (i.e., the side and the rear side) of the head frame 8 as the fixing units for the purpose of positioning the head frame 8 vis-à-vis the apparatus body frame 22.

Figure 8:
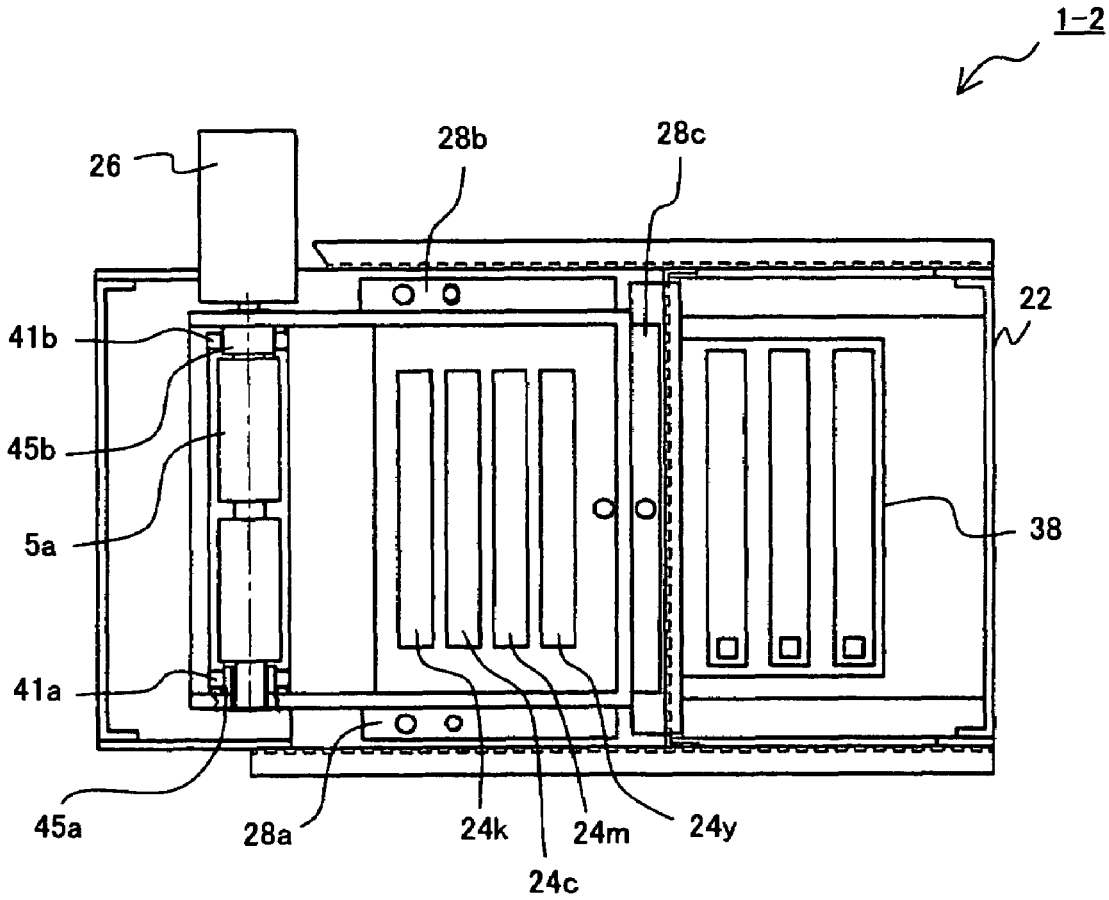
FIG. 8 is a plain view of an image forming apparatus according to the second embodiment.

In the present embodiment, the form of the fixing part 28 shown by FIG. 8 is a little different from the fixing part 28, shown by FIG. 2, according to the first embodiment. Except that the fitting holes and fixing screw holes which are featured for the fixing part 28, where the component numbers are not assigned, are the same as the fitting holes 30 (i.e., a circle hole 30*a* and an elongate hole 30*b*) and the through screw holes 31 (i.e., 31*a* and 31*b*), of the first embodiment, which are shown by FIG. 2.

Likewise, the forms and comprisal of the positioning boss and contact unit which are featured on the apparatus body frame 22 corresponding to the fixing screw holes shown by FIG. 8, and the engaging relationships with the above described fitting holes and fixing screw holes are the same as the forms and comprisal of the positioning boss 29 and contact part 32, and the engaging relationships with the fitting holes 30 and through screw hole 31, of the first embodiment, which are shown by FIGS. 2 and 6.

As shown by FIGS. 8 and 9, an end part of the registration roller 5*b* (while the registration roller 5*b* is behind the registration roller 5*a* and is not seen in FIG. 8) is connected by the registration motor 26, functioning as rotational drive source for the registration roller 5*b*.

An end part of the registration roller 5*a* is connected by the registration clutch 27 which is configured to provide controls of rotation and stoppage of the registration roller 5*a*.

Between the roller end surfaces of the registration roller 5*b* and the head frame 8 are placed by striker members 45*a* and 45*b*, which are formed as a cylinder concentric with the registration roller 5*b*, in a state of not contacting with the shaft thereof.

The structure is such that the striker members 45*a* and 45*b* are positioned right above the positioning arms 41*a* and 41*b* which are equipped in the belt platen 6, and the V notch parts 42 of the positioning arms 41*a* and 41*b* are respectively struck against the striker members 45*a* and 45*b* when the belt platen 6 is lifted by the drive of the elevator arms 19*a*, 19*b*, 19*c* and 19*d*.

And a stopper 46 is fixed to, and projecting downward from, the bottom surface of the head frame 8 opposite the approximate center of the tie bar 43 which is fixed onto the platen 14, and the structure is also such that the lower end surface of the stopper 46 strikes against the tie bar 43 for positioning vertically when the belt platen 6 moves up.

And guides 47*a* and 47*b* are formed at a position contacting the outside of the positioning arm 41*a* which is fixed on the belt platen 6 and at a position lower than the striker member 45*a*. And an elastic member 48 such as a plate spring is fixed at a position lower than the striker member 45*b* on the opposite side of these guides 47*a* and 47*b*.

Referring to FIG. 9, as the belt platen 6 moves up by the drive of the elevator arms 19*a*, 19*b*, 19*c* and 19*d*, the elastic member 48 fixed to the above described head frame 8 contacts with the outside of the positioning arm 41*b* and presses the positioning arm 41*a* to the guides 47*a* and 47*b* which are equipped opposite the elastic member 48.

Subsequently, when the belt platen 6 further moves up by the drive of the elevator arms 19*a*, 19*b*, 19*c* and 19*d*, the positioning arms 41*a* and 41*b* enter the inside of the head frame 8, the V notch parts 42 of the positioning arms 41*a* and 41*b* strike respectively with the striker members 45*a* and 45*b* of the head frame 8, thereby carrying out a mutual positioning between the head frame 8 and the belt platen 6.

Figure 11:
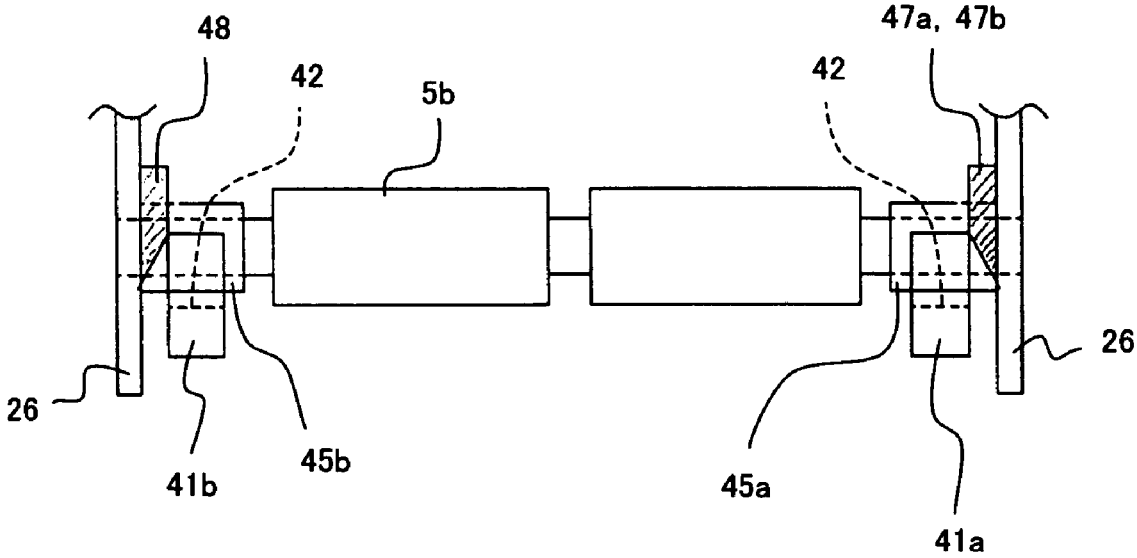
FIG. 11 shows another example of a comprisal of an elastic member and a guide which are fixed to a head frame of an image forming apparatus according to the second embodiment.

Note that the above described elastic member 48, and the guides 47*a* and 47*b* may be configured as a wedge type as shown by FIG. 11 for example.

As described above, the head frame 8 and the apparatus body frame 22 are also positioned by a three-point support in the same manner as the first embodiment also in the case of the present embodiment.

In the positioning, the mutual positioning of the belt platen 6 and head frame 8 is carried out by a three-point engagement, i.e., the respective V notches 42 of the two positioning arms 41*a* and 41*b* and tie bar 43 on the belt platen 6 side, while the striker members 45*a* and 45*b* and stopper 46 on the head frame 8 side in the case of the second embodiment.

Incidentally the present embodiment is also configured to equip a maintenance unit, that is, an ink ejection recovery mechanism, between the head frame 8 and belt platen 6. Let it simply describe the maintenance unit.

The maintenance unit 38 shown by FIGS. 7 and 8 is retained by the apparatus body frame 22 movably in the up and down directions. The maintenance unit 38 equips itself with ink pans 25*k*, 25*c*, 25*m* and 25*y* which are arrayed corresponding to the ink heads 24*k*, 24*c*, 24*m* and 24*y* for providing the function of ink catchers, and an X direction drive mechanism (not shown herein) for driving these ink pans 25*k*, 25*c*, 25*m* and 25*y* in the X positive and X negative directions.

The present embodiment is configured to place the four ink heads 24*k*, 24*c*, 24*m* and 24*y* occupying approximately a half of the upstream side of the belt platen 6 in the cut sheet transport direction at intervals as close as possible in the cut sheet transport direction of the belt 9 of the belt platen 6 and in parallel with the direction perpendicular to the cut sheet transport direction of the belt platen 6, as described above.

On the other hand, the four ink pans 25 (i.e., 25*k*, 25*c*, 25*m* and 25*y*) of the maintenance unit 38 are placed in close intervals equaling to that of the above described ink heads 24*k*, 24*c*, 24*m* and 24*y*.

These four ink pans 25 are controlled, by an X direction drive mechanism, so as to move a cleaning position which is the one facing the lower parts of the ink heads 24*k*, 24*c*, 24*m* and 24*y* shown by FIG. 10 and a retract position occupying approximately a half of the above described apparatus body frame 22 on the downstream side in the cut sheet transport direction shown by FIGS. 7 and 8.

As described above, the configuration is such that the four ink heads 24*k*, 24*c*, 24*m* and 24*y* are placed on the upstream side of the cut sheet transport direction occupying approximately a half of the belt platen 6 and the four ink pans 25 are retracted to the downstream side of the ink heads 24*k*, 24*c*, 24*m* and 24*y* in the cut sheet transport direction at the time of forming an image, thereby capable of making the head frame 8 small.

<Operation>

The next description is of a series of operations in the image forming apparatus 1-2 as described above. Note that a description of the same operation as the first embodiment is omitted here.

First of all, during a standby of the image forming apparatus 1-2 following inputting the power thereto, a restrict unit (not shown herein) thereof makes the elevator arms 19*a*, 19*b*, 19*c* and 19*d* drive for lowering the platen 6, makes the X direction drive mechanism (not shown herein) of the maintenance unit 38 move the ink pans 25 (i.e., 25*k*, 25*c*, 25*m* and 25*y*) to the position opposite the lower part of the ink heads 24 (i.e., 24*k*, 24*c*, 24*m* and 24*y*) and makes the ink pans 25 retrieve an off chance ink spillage out of the ink heads 24, thereby preventing an ink contamination within the image forming apparatus 1-2.

Then, as an instruction for forming an image is input by operating an operator panel (not shown herein) of the image forming apparatus 1-2, or as an instruction signal for forming an image is input from a host equipment (not shown herein) connected by a signal line, the above noted restrict unit of the image forming apparatus 1-2 makes the above noted X direction drive mechanism of the maintenance unit 38 move the ink pans 25 to the retract position, i.e., the position where the ink pans 25 is placed on the downstream side of the ink heads 24 in the cut sheet transport direction.

The above is followed by making the elevator arms 19*a*, 19*b*, 19*c* and 19*d*, which are rotationally driven in the directions of "a" and "b" synchronized with each other, move up the belt platen 6 until the elevator arms 19*a*, 19*b*, 19*c* and 19*d* become the vertical states, thereby setting the gap between the ink heads 24*k*, 24*c*, 24*m* and 24*y* and the belt platen 6 at a predetermined suitable printing distance.

For details, in this event, the elastic member 48 fixed onto the head frame 8 contacts with the positioning arms 41*b*, and the positioning arms 41*a* is accordingly pushed to the guides 47*a* and 47*b* installed on the opposite side of the elastic member 48.

The above is followed by the belt platen 6 being moved up by driving the elevator arms 19*a*, 19*b*, 19*c* and 19*d*, thereby the striker members 45*a* and 45*b*, which are installed in the head frame 8 coaxially with the registration roller 5*b*, being contacted by, and pushed by, the respective V notch parts 42 of the positioning arms 41*a* and 41*b* fixed onto the belt platen 6 and thereby carrying out the mutual positioning of the head frame 8 and belt platen 6.

Also at the same time as the above, the stopper 46 fixed onto, and projecting downward from, the bottom surface of the head frame 8 is struck against the tie bar 43 of the belt platen 6. By this, a load larger than the force for moving up the belt platen 6 is levied to the elevator arms 19*a* and 19*b*, accordingly operating the torque limiter 44 connected to the elevator drive source 20 for the elevator arms 19*a* and 19*b* for cutting off the drive force from the elevator drive source 20 thereto, resulting in the belt platen 6 stopping moving up.

By this, the vertical distance between the head frame 8 and belt platen 6 is established, and the position of the belt platen 6 in the axial direction of the registration roller 5*b* is established. Since the parallelism of the registration roller pair 5 with the ink heads 24*k*, 24*c*, 24*m* and 24*y* is secured by the mounting accuracies, the positional accuracies of the belt platen 6, registration roller pair 5 and ink heads 24*k*, 24*c*, 24*m* and 24*y* are secured by the above described positioning.

The ink pans 25*k*, 25*c*, 25*m* and 25*y* are placed above the belt platen 6 and are retracted to the retract position readied on the upstream side of the cut sheet transport direction vis-à-vis the ink heads 24*k*, 24*c*, 24*m* and 24*y*.

In this state, the inks are ejected from the ink heads 24*k*, 24*c*, 24*m* and 24*y* on the cut sheet 3 picked up by the pickup roller 4, fed through the registration roller pair 5*a* and 5*b* and transported by the belt 9 of the belt platen 6, thereby forming an image on the cut sheet 3.

Also in this embodiment, if an image non-uniformity due to a change in the transport direction at the time of handing over the cut sheet 3 from the registration roller pair 5 to the belt platen 6 is recognized, a work for making the transport direction of the belt platen 6 identical with that of the registration roller pair 5 in order to correct the image non-uniformity is the same as in the case of the first embodiment.

Also in the present embodiment, the registration roller pair 5 is not retained by the apparatus body frame 22 and instead retained by the head frame 8 which mounts the ink heads 24*k*, 24*c*, 24*m* and 24*y*, and therefore a distortion of the apparatus body frame 22 does not influence the positional accuracy of the registration roller pair 5 and the ink heads 24*k*, 24*c*, 24*m* and 24*y*. Moreover, the fixing method adopts three points with the smallest possible contact areas.

Therefore, the present embodiment also is capable of maintaining the respective positional accuracies of the head frame 8, belt platen 6, ink heads 24 and registration roller pair 5 even if a distortion occurs in the apparatus body frame 22 due to a logistics and transportation condition, hence enabling a provision of a high image quality image forming apparatus.

The present embodiment is also configured to make the ink pans 25 of the maintenance unit 38 retract completely to the downstream side of the ink heads 24 in the cut sheet transport direction, thereby making each of the ink heads 24 close with one another.

Thus making each of the ink heads 24 close with one another makes it possible to reduce an influence of ejected inks from the respective ink heads 24 on a displacement of the overlapping colors caused by the transport accuracy of the belt platen 6.

Also accomplished are making the head frame 8 smaller and lighter weight. A distortion of the apparatus body frame 22 caused by a logistics and transportation is reduced by lightening the total weight of the apparatus, an influence to the head frame 8 fixed onto the apparatus body frame 22 at the three points is further reduced and therefore a printing accuracy after a logistics and transportation is secured.

On the other hand, the belt platen and the head frame are positioned nearby the registration roller pair 5, thereby making it possible to improve the accuracies of the transport directions of the registration roller pair 5 and of the belt platen 6.

And since the head frame 8 and the belt platen 6 are positioned by a striking, the distance between the ink heads 24, which is mounted on the head frame 8, and the belt platen 6 is firmly secured.

And since the configuration is as described above, the head frame 8, i.e., the recording unit, is positioned against the belt platen, i.e., the transport mechanism, by striking the former against the latter at three points. Because of this, even if the apparatus body frame 22 is distorted for example, the relative positional accuracy of the head frame 8 and belt platen 6 is hardly influenced.

And making the head frame 8 smaller further reduces an influence of the apparatus body frame 22 on the head frame 8 which is fixed thereto at the three points compared to the first embodiment and maintains the respective positional accuracies of the head frame 8, belt platen 6, ink heads 24 and registration roller pair 5, hence enabling a provision of a high image quality image forming apparatus.

Note that the form of the respective V notch parts featured in the positioning arms 41*a* and 41*b* used for positioning the belt platen 6 and head frame 8 may be configured as a U shape, in lieu of being limited to the V shape.

Third Embodiment

<Comprisal>

The next description is of a third embodiment of the present invention while using FIGS. 12 through 16. Note that the same comprisal part as the above described first or second embodiments are shown by assigning the same component number as the first or second embodiments where a description is deemed as necessary for the third embodiment, while an assignment of component number and a description are omitted where a description is deemed as unnecessary for the third embodiment, in the drawings used for the following description.

And the description of a function and operation relating to a part with the same operation as the first or second embodiments for the engagement relationships of respective units are avoided as much as possible for simplicity.

The first description is of the head frame 8 for mounting a plurality of ink heads. An image forming apparatus 1-3 according to the third embodiment is configured to place ahead frame 8 for mounting a plurality of ink heads 24 (i.e., 24*k*, 24*c*, 24*m* and 24*y*) above a belt platen 6.

And likewise the second embodiment, the respective color ink heads 24*k*, 24*c*, 24*m* and 24*y* are placed in the sequence of respective colors (K, C, M, and Y) at the closest possible interval along the cut sheet transport direction of a belt 9 in a respective parallelism with the direction perpendicular to the cut sheet transport direction of the belt 9.

Figure 13:
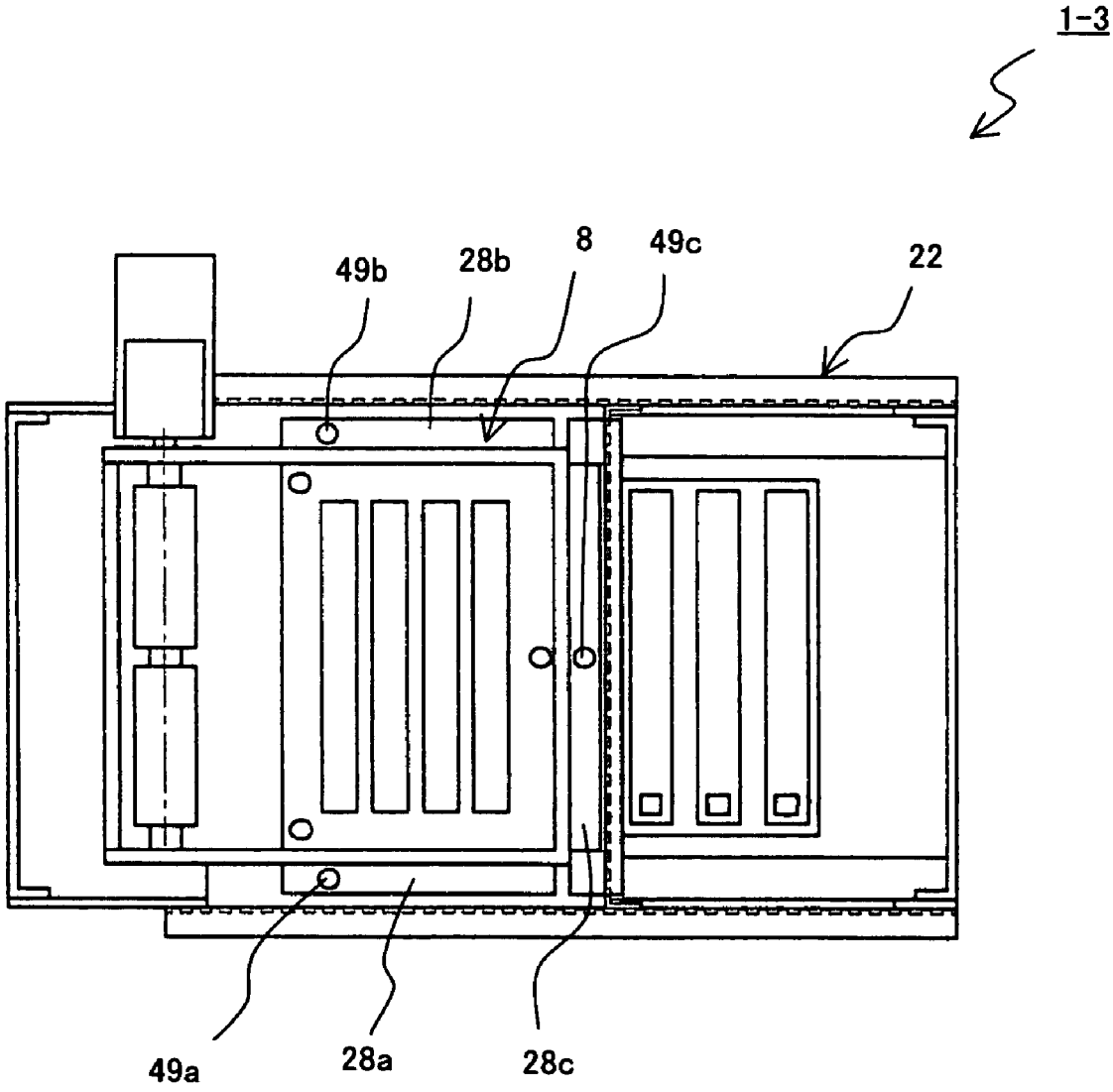
FIG. 13 is a plain view of an image forming apparatus according to the third embodiment.
Figure 14:
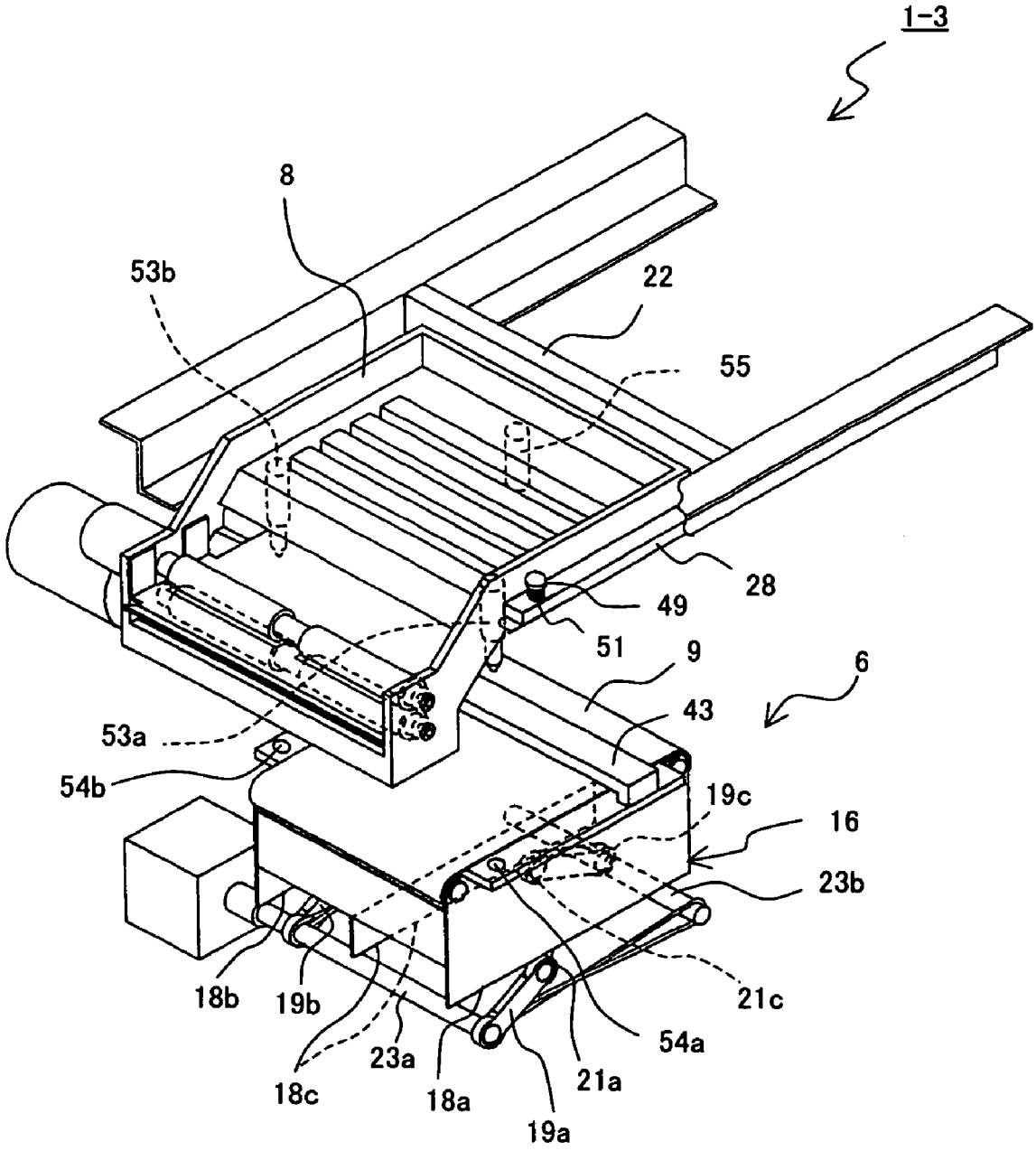
FIG. 14 is a diagonal view showing a head unit as a recording unit separated, from a belt platen, of an image forming apparatus according to the third embodiment.
Figure 15:
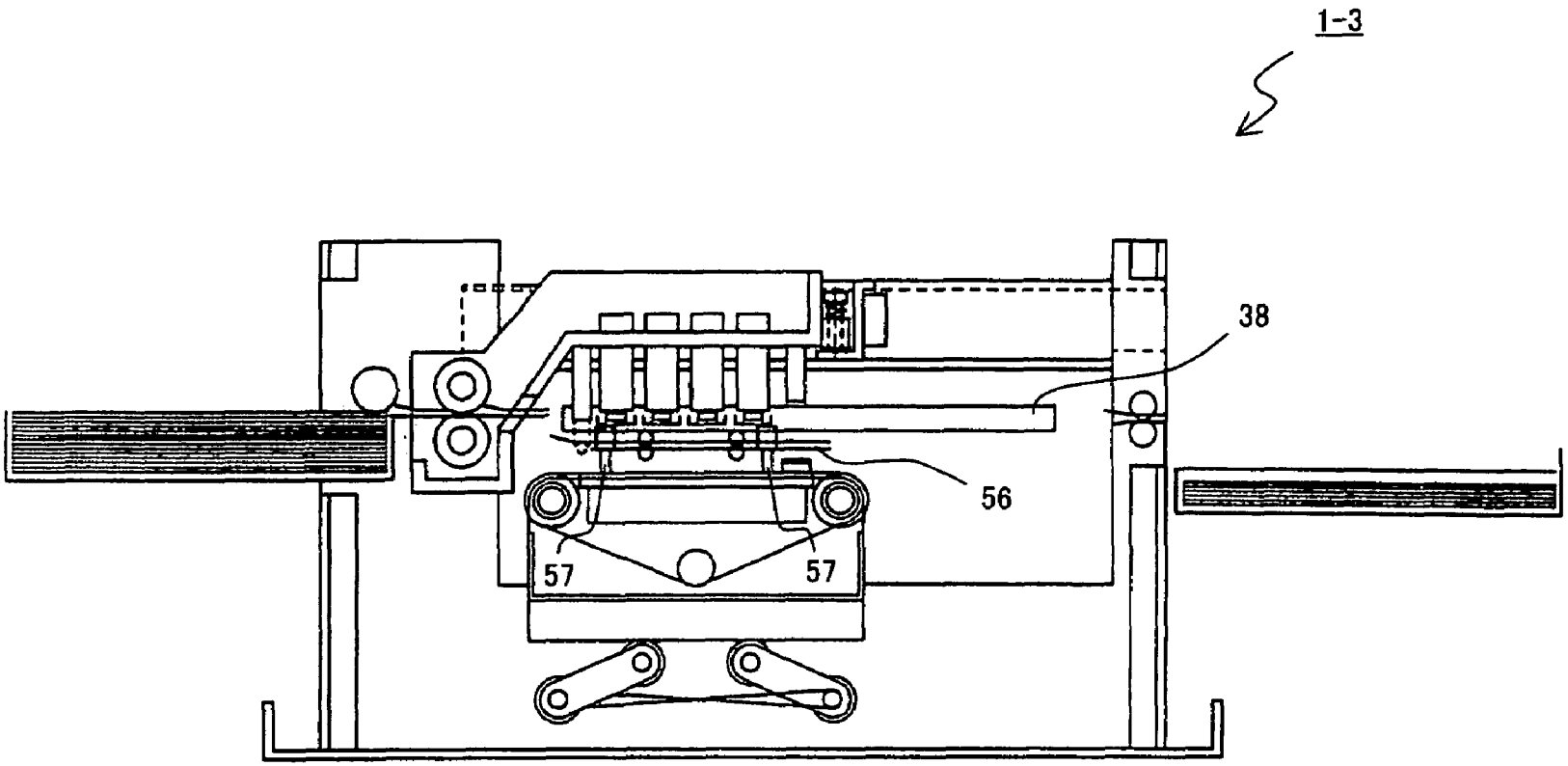
FIG. 15 is a side view at the time of recovery by a head recovery mechanism of an image forming apparatus according to the third embodiment.
Figure 16:
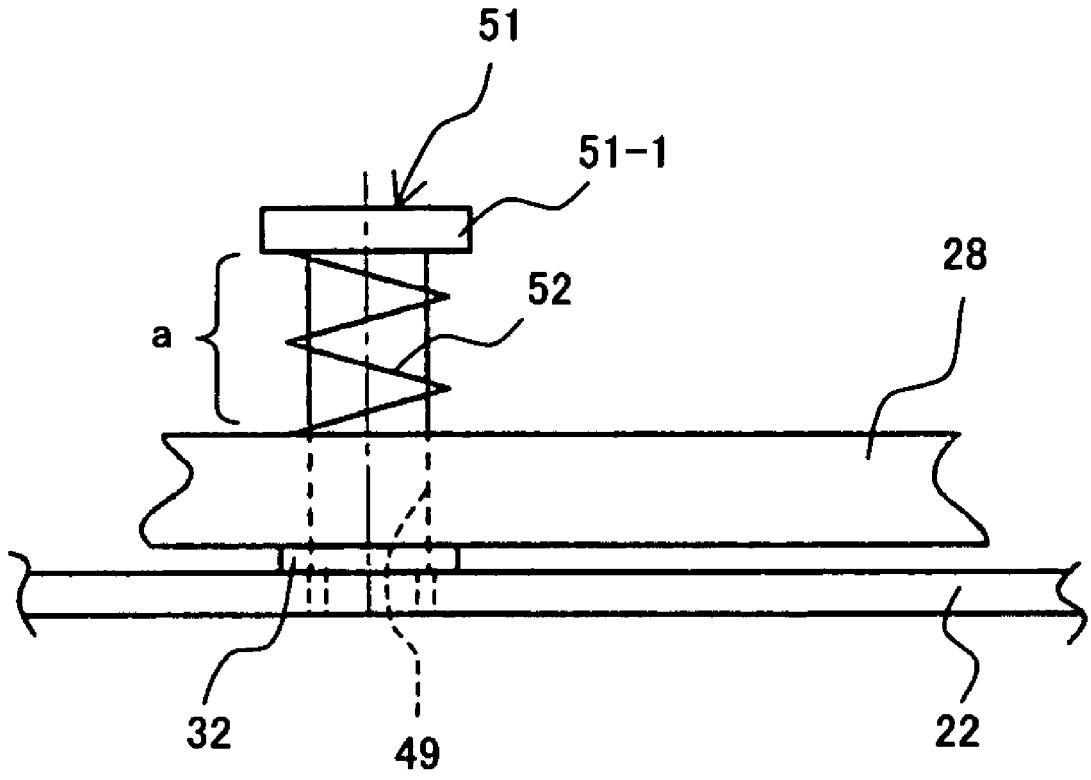
FIG. 16 is an enlarged diagram showing a positioning & fixing part of a head frame and apparatus body frame of an image forming apparatus according to the third embodiment.

As shown by FIG. 13, fixing parts 28 (i.e., 28*a*, 28*b* and 28*c*) are featured on both sides of the head frame 8 in the direction perpendicular to the cut sheet transport direction and on a side on the downstream side thereof in the cut sheet transport direction.

And a circular contact part 32 is formed in advance in the position corresponding to a pin insertion hole 49 of each of the fixing parts 28 on the bottom surface thereof. The present embodiment is also configured to engage and fix the apparatus body frame 22 with head frame 8 by way of the smallest possible contact areas of the contact parts 32.

Note that the present embodiment is configured such that a pin 51 having a flange-shaped head part 51-1 is inserted through the pin insertion hole 49 of the contact part 32 with the screw part at the end of the pin 51 being screwed in, and fixed to, the apparatus body frame 22 in the above described engagement.

The pin 51 forms a gap "a" between the flange-shaped head part 51-1 and the fixing part 28. A coil spring 52 having a pressing force is outserted to the pin 51 for intervening between the flange-shaped head part 51-1 and the fixing part 28.

By this, the apparatus body frame 22 and the head frame 8 are temporarily fixed by being pressed by the head part 51-1 of the pin 51 and coil spring 52 by way of the contact part 32.

And the pin insertion holes 49 featured in the fixing parts 28*a*, 28*b* and 28*c* are configured such that either one of the pin insertion holes 49 of the fixing parts 28*a* and 28*b* is a circular hole without a play and the other pin insertion hole 49 is an elongate hole having a play in the direction perpendicular to the cut sheet transport direction, and the pin insertion hole 49 of the fixing part 28*c* is a circular loose fit hole vis-à-vis the pin 51.

In the present embodiment, the fact that the fixing parts 28*a*, 28*b* and 28*c* have rigidity for enduring a total weight of the head frame 8 and associated components as well as the striking force of the belt platen is the same as the first and second embodiments.

And step pins 53*a* and 53*b* are fixed downward on the bottom surface of the head frame 8. These step pins 53*a* and 53*b* are installed at positions opposite positioning holes 54*a* and 54*b* which are featured in the platen 14 of the belt platen 6.

As the belt platen 6 is moved up by the elevator mechanism, the stepped portions of the step pins 53*a* and 53*b* fit with the positioning holes 54*a* and 54*b* of the platen 14 for positioning in the left and right direction, and also the ring shape surface on the step of the step pins 53*a* and 53*b* strike on the top surface of the platen 14, thereby making the distance between the ink heads 24*k*, 24*c*, 24*m* and 24*y* and the belt platen 6 correct and positioning in the height direction.

And at the same time as above, a stopper 55 fixed onto, and projecting downward from, the bottom surface in the rear of the head frame 8 (on the downstream side in the cut sheet transport direction) contacts with the approximate center of the tie bar 43 which is fixed nearby the rear of the platen 14, thereby positioning the rear part of the head frame 8.

The above described positioning holes 54*a* and 54*b* are featured in both end parts on the outside of the belt 9 on the upstream side of the platen 14 in the cut sheet transport direction.

The positioning hole 54*a* is a circle, while the positioning hole 54*b* is an elongate hole extending in the direction perpendicular to the cut sheet transport direction.

And the present embodiment is configured to place the belt platen 6 by expanding in a range corresponding to the just beneath of four ink heads 24*k*, 24*c*, 24*m* and 24*y*, in lieu of extending across approximately the entirety of the apparatus body frame 22 in the cut sheet transport direction as in the case of the first or second embodiments.

That is, the belt platen 6 according to the present embodiment is configured to be biased to the upstream of the cut sheet transport direction, thereby making it small and light weight as much as possible.

And the above described tie bar 43 is placed on the downstream side of the belt platen 6 in the cut sheet transport direction due to the configuration of the above described belt platen 6 being biased toward the upstream side in the cut sheet transport direction, and is fixed on the platen 14 at the position corresponding to the right beneath the stopper 55 in the state of distancing from the belt 9 by no less than 5 mm so as not to hamper the cut sheet 3 passing on the belt 9.

The present embodiment is configured in such a manner that the belt platen 6 is supported by three elevator arms 19, that is more specifically, lower edges 18 (i.e., 18*a*, 18*b* and 18*c*), which are formed in three places, i.e., both ends and the center in the direction perpendicular to the cut sheet transport direction on the bottom of a platen frame 16, are contacted by rollers 21 (i.e., 21*a*, 21*b* and 21*c*) respectively equipped at the end of three elevator arms 19 (i.e., 19*a*, 19*b* and 19*c*) for moving up and down the belt platen 6.

Among the above described three elevator arms 19, the two elevator arms 19*a* and 19*b* are installed parallel with each other on the upstream side of the cut sheet transport direction, while the elevator arm 19*c* is installed at the approximate center in the direction perpendicular to the cut sheet transport direction and also at the position right under the stopper 55, which is fixed onto the head frame 8, in the downstream of the cut sheet transport direction.

Figure 12:
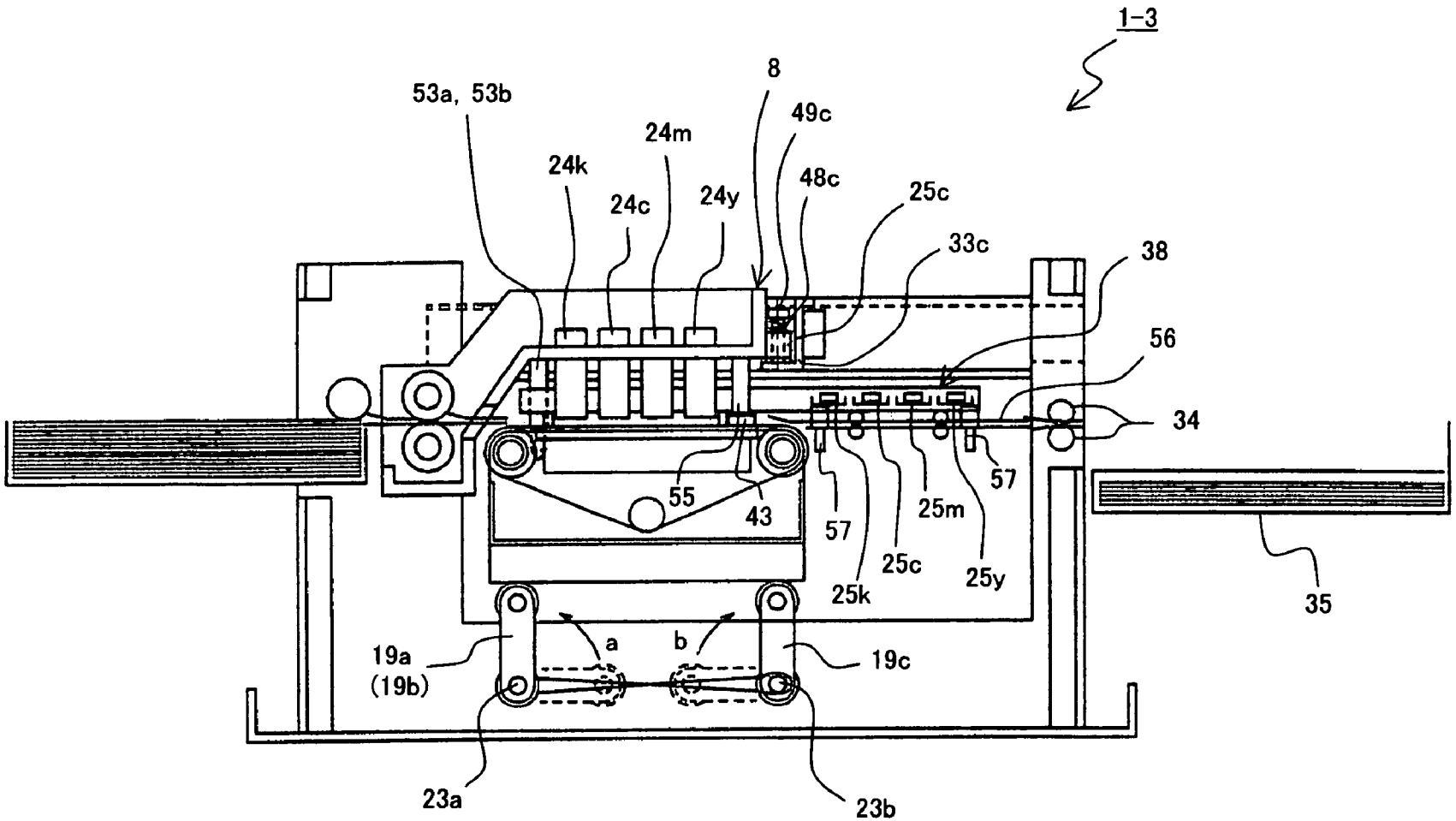
FIG. 12 is a side view of an image forming apparatus according to a third embodiment.

The elevator arms 19*a*, 19*b* and 19*c* are rotated synchronously with each other in the arrows "a" and "b" directions and the reverse in the range of approximately 90 degrees by arm shafts 23*a* and 23*b* which are rotationally supported by the apparatus body frame 22 as shown by FIG. 12.

As the arm shafts 23*a* and 23*b* rotate in the forward direction of the arrows "a" and "b", respectively, the elevator arms 19*a*, 19*b* and 19*c* move from the horizontal position indicated by the dotted lines to the vertical position indicated by the solid lines as shown by FIG. 12.

Associated with the movement of the elevator arms 19*a*, 19*b* and 19*c*, the respective rollers 21*a*, 21*b* and 21*c* respectively equipped at the end of the elevator arms 19*a*, 19*b* and 19*c* lift the lower edges 18*a*, 18*b* and 18*c* while rolling thereon, By this, the belt platen 6 moves up, or down.

Also in this case the position of the belt platen 6 at the time of the elevator arms 19*a*, 19*b* and 19*c* becoming the vertical states is set as a printing position at the time of the image forming processing.

The next is an outline description of a maintenance unit as an ink ejection recovery mechanism. A maintenance unit 38 is installed between the head frame 8 and the belt platen 6.

The maintenance unit 38 is movably retained by the apparatus body frame 22 in the up and down direction and comprises the ink pans 25*k*, 25*c*, 25*m* and 25*y* which are arrayed corresponding to the ink heads 24*k*, 24*c*, 24*m* and 24*y*.

The ink pans 25*k*, 25*c*, 25*m* and 25*y* respectively have the functions of ink catchers as in the case of the first or second embodiments. And the maintenance unit 38 is equipped with an X direction drive mechanism (not shown herein) for making these ink pans 25*k*, 25*c*, 25*m* and 25*y* in the X direction.

The ink pans 25 (i.e., 25*k*, 25*c*, 25*m* and 25*y*) are enabled to move to a cleaning position (refer to FIG. 15) positioned in a lower position facing the ink heads 24 (i.e., 24*k*, 24*c*, 24*m* and 24*y*) and move to a retract position (refer to FIG. 12) located on the downstream side of the ink heads 24 in the cut sheet transport direction by retracting from below the ink heads 24 when the ink heads 24 ejecting inks onto the cut sheet 3.

Also in the case of the present embodiment, each of the ink heads 24 (i.e., 24*k*, 24*c*, 24*m* and 24*y*) is installed at the closest possible interval vis-à-vis the cut sheet transport direction, and therefore the head frame 8 according to the present embodiment for mounting these ink heads 24 is configured to make it small in the same way as the second embodiment.

And a transport unit 56 for leading the cut sheet 3, to the exit roller pair 34, transported by the belt platen 6 is installed underneath the ink pans 25 (i.e., 25*k*, 25*c*, 25*m* and 25*y*) of the maintenance unit 38 as a part thereof.

The above noted transport unit 56 is fixed onto the maintenance unit 38 so as to move synchronously with the movement of the ink pans 25 in the X direction. The bottom surface of the transport unit 56 is fixed by transport pins 57 in three or more places for striking against places outside the range of the belt 9 of the belt platen 6 for the purpose of specifying the distance between the maintenance unit 38 and the ink head 24 when the transport unit 56 moves underneath the ink heads 24.

<Operation>

The next description is of a series of operations in the image forming apparatus 1-3 of the above described configuration. Note that a description of the same operation as the first and second embodiments is omitted here.

During a standby of the image forming apparatus 1-3, the belt platen 6 descends by driving the elevator arms 19*a*, 19*b* and 19*c* controlled by a restrict unit (not shown herein), the maintenance unit 38 makes an X direction drive mechanism move the ink pans 25 to the position facing the ink heads 24.

In this event, the maintenance unit 38 is in the state of being supported by the belt platen 6 by way of the transport pins 57 fixed onto the bottom surface of the transport unit 56 which is installed underneath the ink pans 25.

By an image recording instruction from an external host equipment, the restrict unit makes the X direction drive mechanism of the maintenance unit 38 move the ink pans 25 to the downstream side of the ink heads 24 in the cut sheet transport direction. The transport unit 56 also moves to the downstream side of the cut sheet transport direction associated with the movement of the ink pans 25.

Next, the belt platen 6 ascends by being driven by the elevator arms 19*a*, 19*b* and 19*c* which rotate synchronously in the arrows "a" and "b" directions. As the elevator arms 19*a*, 19*b* and 19*c* come close to the vertical positions and the step pins 53*a* and 53*b* fixed onto the bottom surface of the head frame 8 fit to the positioning holes 54*a* and 54*b*, respectively, which are featured in the platen 14 of the belt platen 6, thereby positioning the head frame 8 and the belt platen 6.

The above is followed by driving the elevator arms 19*a*, 19*b* and 19*c* until the complete vertical states, making the ring-shaped surface of the step of each of the step pins 53*a* and 53*b* strike against the top surface of the platen 14 and also making the stopper 55 which is fixed onto, and projecting downward from, the head frame 8 strike against the tie bar 43 that is fixed to the platen 14.

In this event, the head frame 8 is pressed on the apparatus body frame 22 by a pressing force of the spring 52 of each fixing part 28 (refer to FIG. 16), the belt platen 6, however, further moves up against the pressing force of the spring 52, resulting in compressing the spring 52 and the head frame 8 being lifted by the belt platen 6.

By this, the head frame 8 and the belt platen 6 are positioned in the height direction by the ring-shaped surface of the step of the step pins 53*a* and 53*b* striking against the top surface of the platen 14 and the stopper 55 striking against the tie bar 43.

Incidentally, since the maintenance unit 38 is supported by the platen 14 in the state of being placed thereon, as the belt platen 6 ascends the maintenance unit 38 also ascends simultaneously.

When the belt platen 6 strikes against the head frame 8 to be set at the position maintained for a suitable printing distance, the transport unit 56 fixed onto the maintenance unit 38 is placed on the cut sheet transport path which extends from the rear edge of the belt platen 6 to the exit roller pair 34.

The above is followed by transporting the cut sheet 3, which has been transported by the pickup roller 4, registration roller pair 5 and belt platen 6, and image-formed by the ink heads 24 ejecting the respective color ink droplets, is then succeeded by the transport unit 56, which is integrated with the maintenance unit 38, and further exit roller pair 34 to be ejected onto the exit paper tray 35.

If an image non-uniformity due to a change of transport direction of a cut sheet 3 is recognized, the adjustment method is the same as the first or the second embodiment.

And the present embodiment is also configured to retract the ink pans 25 of the maintenance unit 38 completely to the downstream side of the ink heads 24 in the cut sheet transport direction, thereby making an interval of each of the ink heads 24 close as much as possible, as with the second embodiment.

This makes it possible to reduce a displacement of overlapping colors of each ejected ink influenced by the transport accuracy of the belt platen 6. Additionally, the head frame 8 can be made smaller and lighter.

And the cut sheet transport path from the belt platen 6 to the exit roller pair 34 is formed by the transport unit 56 which is integrally installed with the maintenance unit 38 that retracts in between the belt platen 6 and the exit roller pair 34 at the time of recording an image, thereby making it possible to shorten the length of the belt platen 6, accomplish a smaller belt platen 6 and further light weight.

And a distortion of the apparatus body frame 22 due to a logistics and transportation is reduced by lightening the total apparatus weight and therefore an influence to the head frame 8 fixed to the apparatus body frame 22 at three points is further reduced, hence making it possible to secure a printing accuracy after a logistics and transportation.

And, at the time of printing, the ring-shaped surface of the step pins 53*a* and 53*b* striking the upper surface of the platen 14 and the stopper 55 striking the tie bar 43 securely position the head frame 8 which has been temporarily positioned to the apparatus body frame 22 by the pressing force of the spring 52, thereby securing a predetermined distance between the ink heads 24 and the belt platen 6.

Such configuration makes the printing hardly influenced by a distortion of the apparatus body frame 22.

Meanwhile, as for support configuration of the belt platen 6, there are many cases of an actual three-point support vis-à-vis a designed four-point support where a installation condition of the apparatus changes which three points actually support, out of the designed four and therefore a positional accuracy is ill influenced.

The present embodiment, however, is configured to basically support the belt platen 6 by three points, i.e., the elevator arms 19*a*, 19*b* and 19*c*, and therefore the same three points always support the belt platen 6, thereby enabling a stable positional accuracy to be maintained independent of an installation condition in addition to the effects of the first and second embodiments.

And featuring surfaces for striking the belt platen 6 and the head frame 8 at the positions opposite the contact points of the elevator arms 19*a*, 19*b* and 19*c* and belt platen 6 at the time of forming an image prevent a moment by engagement from working on the head frame 8 or belt platen 6, thereby enabling securing a highly accurate flatness.

This reduces a total influence of a distortion of the apparatus body frame 22 and enables a provision of a light weight, high image quality image forming apparatus.

Fourth Embodiment

<Comprisal>

Figure 17:
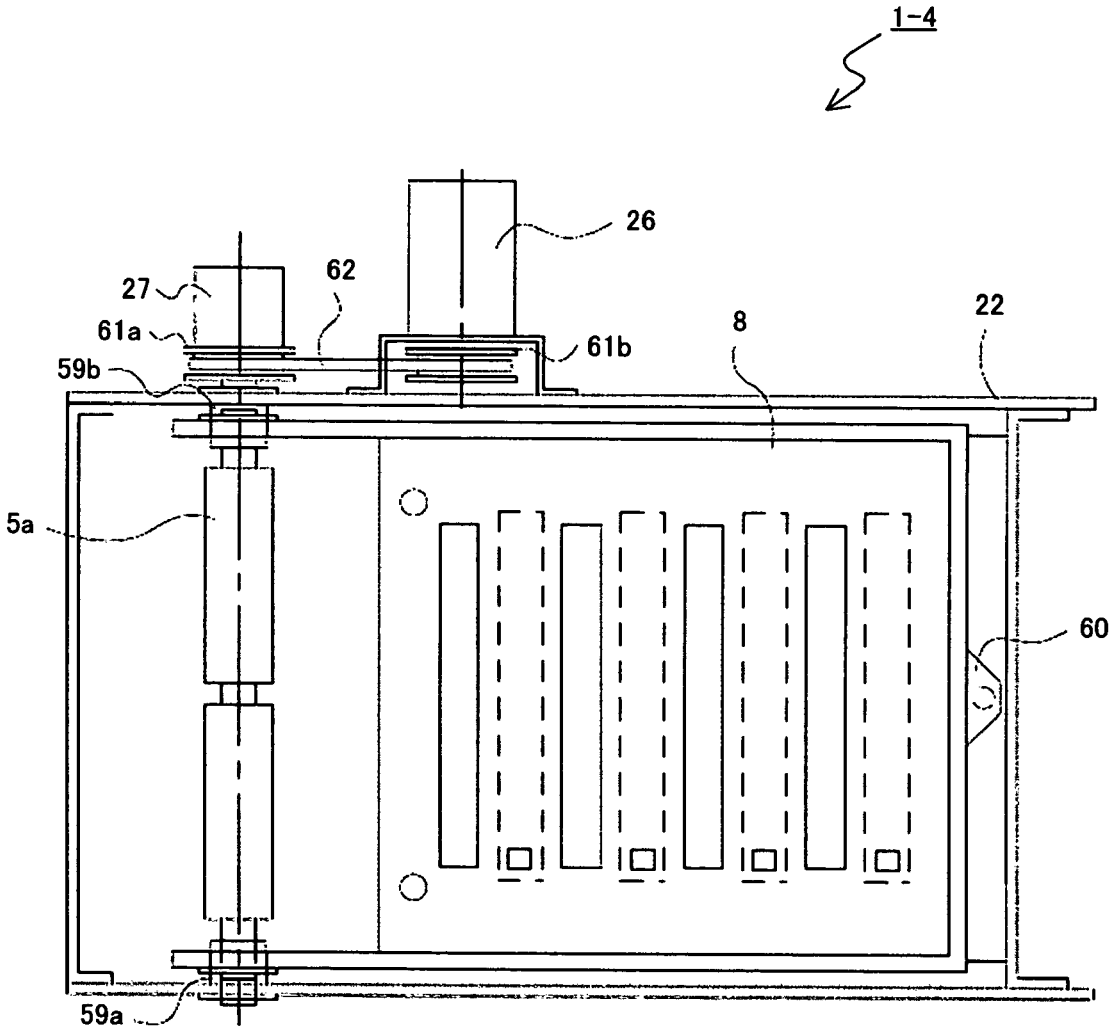
FIG. 17 is a plain view of an image forming apparatus according to a fourth embodiment.
Figure 18:
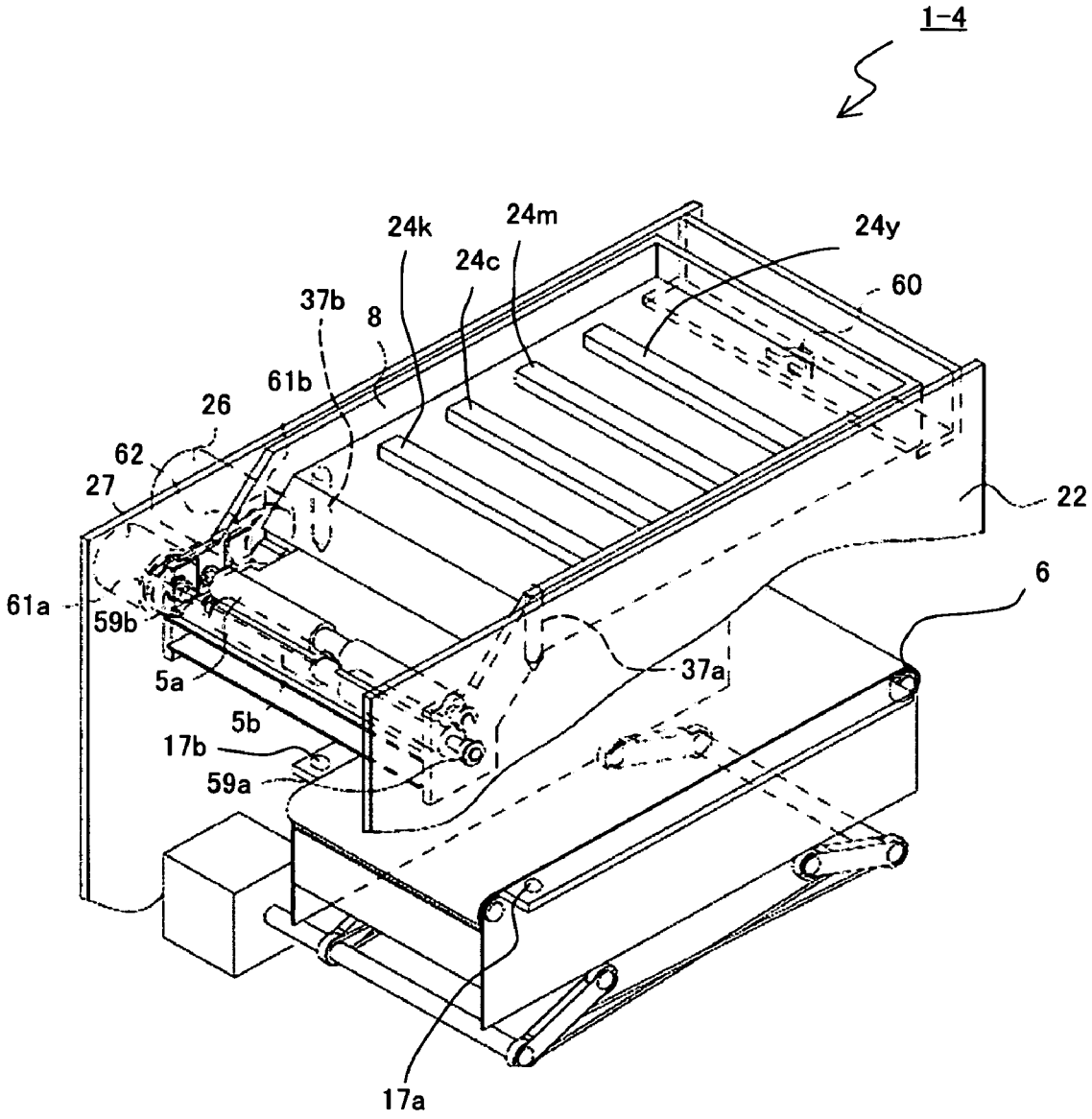
FIG. 18 is a diagonal view showing a head unit as a recording unit separated, from a belt platen, of an image forming apparatus according to the fourth embodiment.
Figure 19:
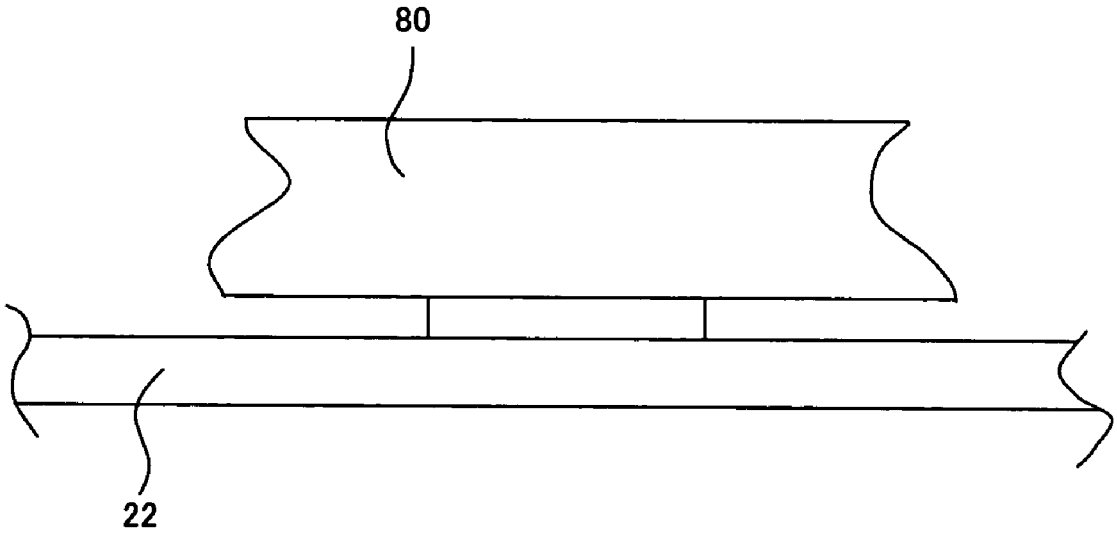
FIG. 19 is an enlarged diagram showing a retaining part of a head frame and apparatus body frame of an image forming apparatus according to the fourth embodiment.

Furthermore, the following is a description of a fourth embodiment according to the present invention by using FIGS. 17 through 19. Note that the same comprisal part as the above described first, second or third embodiments are shown by assigning the same component number as the first, second and third embodiments where a description is deemed as necessary for the fourth embodiment, while an assignment of component number and a description are omitted where a description is deemed as unnecessary for the fourth embodiment, in the drawings used for the following description.

And the descriptions of the function and the operation relating to the engagement relationships of the respective units relative to a part of the same operation as the first, second or third embodiments are avoided as much as possible for simplicity.

The first description is of a head frame 8 for mounting a plurality of ink heads. An image forming apparatus 1-4 according to the fourth embodiment places the head frame 8, which mounts a plurality of ink heads 24 (i.e., 24*k*, 24*c*, 24*m* and 24*y*), above a belt platen 6.

A registration roller pair 5 (i.e., 5*a* and 5*b*), as the transport roller, is installed on the extension line of the transport path for a cut sheet 3 which is fed from a pickup roller 4 to the inside of the apparatus body.

As shown by FIGS. 17 and 18, both ends of the lower registration roller 5*b* are extended so as to penetrate an apparatus body frame 22, and are rotationally supported thereby by way of rotation members 59*a* and 59*b* which penetrate and fit with the side face of the apparatus body frame 22 and that of the head frame 8. Meanwhile, the registration roller 5*a* pressed by plural springs (not shown herein) so as to press the registration roller 5*b* is installed in parallel therewith and is freely rotationally retained by the head frame 8.

One end of the above described registration roller 5*b* is rotationally driven by a registration motor 26, which is fixed to the apparatus body frame 22, by way of pulleys 61*a* and 61*b* and a timing belt 62. Note that the registration roller 5*b* is also connected by a registration clutch 27 so that the registration roller 5*b* is controlled for engaging and disengaging the drive of the registration motor 26.

And a retainer part 60 is featured on the side surface on the downstream side of the cut sheet transport direction. The bottom surface of the retainer part 60 has a ring-shaped form as shown by FIG. 19 so that the apparatus body frame 22 and the head frame 8 contact by way of the smallest possible contact area.

The retainer part 60, in lieu of being fixed to the apparatus body frame 22, is retained by mounting one point of the head frame 8 on the apparatus body frame 22 with the own weight thereof.

By this configuration, the head frame 8 is supported by two points by way of the rotation members 59*a* and 59*b* and registration roller 5*a*, and additionally held by one point by the retainer part 60, vis-à-vis the apparatus body frame 22.

According to the present invention, the head frame 8 is positioned and supported by two points on the registration roller 5*b* rotationally retained by the apparatus body frame 22 and one point at the retainer part 60 featured on the head frame 8, thereby being mounted and retained by the apparatus body frame 22.

Due to this, although a distortion of the apparatus body frame 22 is transferred to two places, i.e., the both ends, of the registration roller 5*b* and to the head frame 8 retaining the registration roller 5*b*, the head frame 8 per se is not deformed by the aforementioned distortion because another one point of the head frame 8 is supported, movably only in the direction parallel with the cut sheet 3, by the apparatus body frame 22 by way of the retainer part 60.

As described above, the positional accuracies of the registration roller pair 5 and ink heads 24*k*, 24*c*, 24*m* and 24*y* are not influenced because of an absence of a distortion in the head frame 8.

And, since the registration motor 26 for driving the registration roller 5*b* is fixed to the apparatus body frame 22, it is possible to reduce the total weight forced on the head frame 8, hence enabling prevention of a deformation of the head frame 8 caused by a load relating to the weight of the head frame 8.

Therefore, if a distortion occurs in the apparatus body frame 22 due to a logistics and transportation condition, the respective positional accuracies of the head frame 8, belt platen 6, ink heads 24*k*, 24*c*, 24*m* and 24*y* and registration roller pair 5 are maintained, thereby maintaining the transport accuracy of the cut sheet 3 vis-à-vis the ink heads 24*k*, 24*c*, 24*m* and 24*y* and enabling a provision of a high image quality image forming apparatus.

Note that the present embodiment is configured to carry out the positioning of the head frame 8 and platen 14 on a line perpendicular to the paper transport direction by the positioning pins 37*a* and 37*b*, and positioning holes 17*a* and 17*b*, the placement of either one pair, e.g., the positioning pin 37*a* and positioning hole 17*a*, however, may be placed diagonally across from the other pair, i.e., the positioning pin 37*b* and positioning hole 17*b*, vis-à-vis the platen 14.

Since positions in the width direction of the platen 14 which is perpendicular to the paper transport direction is exceeded by such a diagonal positions in terms of the distance therebetween and therefore the positioning accuracy is further improved.

Fifth Embodiment

<Comprisal>

Figure 20:
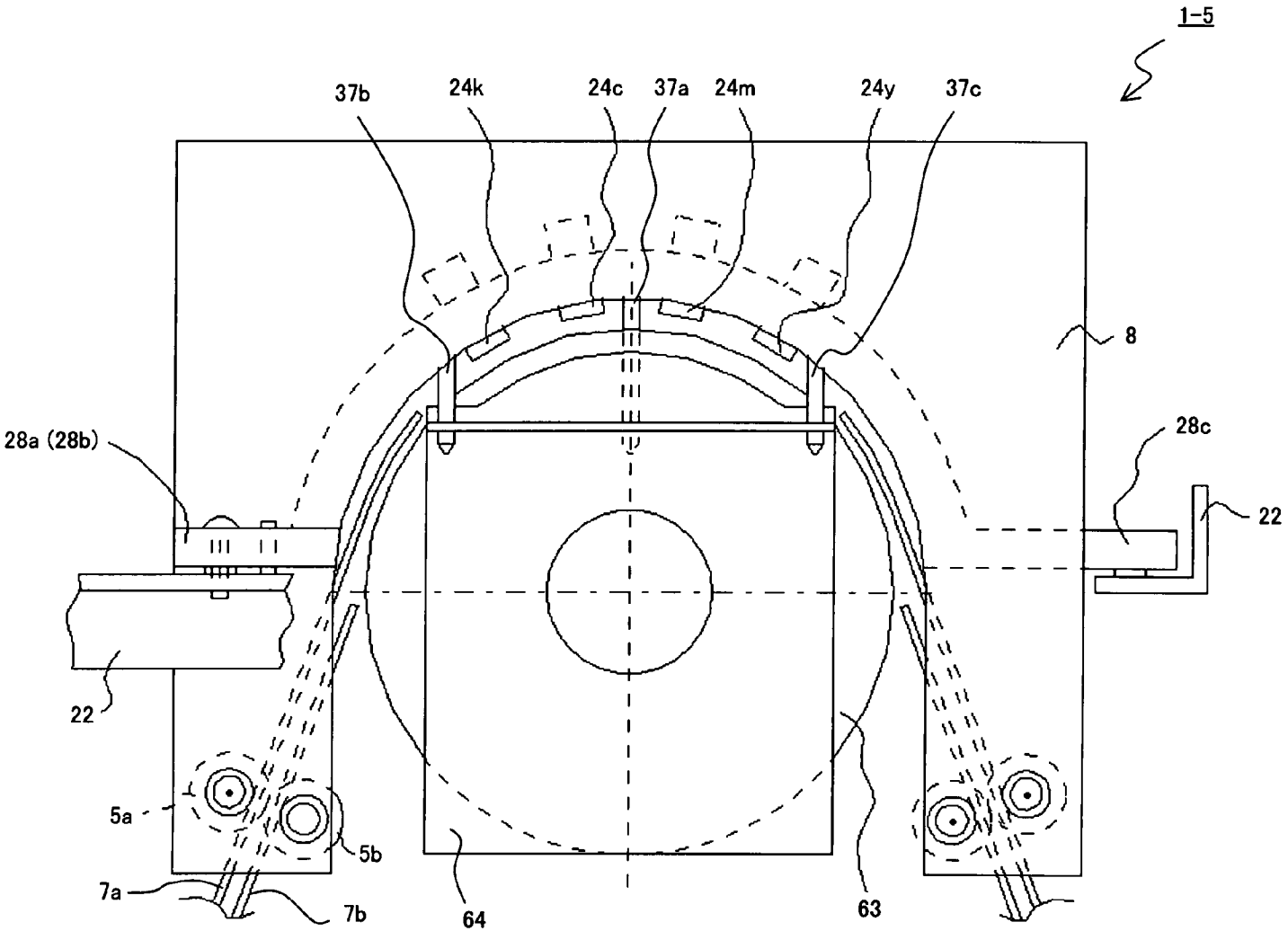
FIG. 20 is a side view of an image forming apparatus according to a fifth embodiment.

FIG. 20 is a side view of an image forming apparatus according to a fifth embodiment.

The following description is of the fifth embodiment according to the present invention by referring to the above noted FIG. 20. Note that the same comprisal part as the above described first, second, third or fourth embodiments is shown by assigning the same component number as the first, second, third and fourth embodiments where a description is deemed as necessary for the fifth embodiment, while an assignment of component number and a description are omitted where a description is deemed as unnecessary for the fifth embodiment, in the drawings used for the following description.

And the descriptions of the function and the operation relating to the engagement relationships of the respective units relative to a part of the same operation as the first, second, third or fourth embodiments are avoided as much as possible for simplicity. The first description is of a head frame 8 for mounting a plurality of ink heads. An image forming apparatus 1-5 according to the fifth embodiment places the head frame 8, which mounts a plurality of ink heads 24 (i.e., 24*k*, 24*c*, 24*m* and 24*y*), above a transport drum 63.

As shown by FIG. 20, the head frame 8 retains a registration roller pair 5*a* and 5*b* freely rotationally and is installed in a position where a cut sheet 3 is wound around the transport drum 63.

The layout is so as to guide a cut sheet 3 to a registration roller pair 5 (i.e., 5*a* and 5*b*) and make an upper registration guide 7*a* and a lower registration guide 7, which further lead the cut sheet 3 from the registration roller pair 5 to a transport drum 63, and which face with each other with a distance suitable so as to let the cut sheet 3 pass through.

The transport drum 63 is rotationally retained on its both shaft ends by a drum frame 64, and is rotationally driven by a drive source (not shown herein).

The cut sheet 3 is suctioned by the transport drum 63 and is transported by the transport drum 63 rotating.

The adsorption of the cut sheet 3 onto the transport drum may use an electrostatic adsorption method or a suction method by installing a suction fan inside the transport drum 63.

As shown by FIG. 20, fixing parts 28 (i.e., 28*a*, 28*b* and 28*c*) are featured totaling in three places, as the fixing parts for the purpose of positioning the head frame vis-à-vis the apparatus body frame 22, on the sides (i.e., the side and the rear side) of the head frame 8.

By this configuration, the head frame 8 is fixed to the apparatus body frame 22 at the three places. The fixing part 28*b*, while it is not possible to be seen in the drawing because of being a side view, is featured opposite the fixing part 28*a*. The method for fixing to the apparatus body frame 22 by the fixing parts 28 (i.e., 28*a*, 28*b* and 28*c*) is configured in the same manner as the first embodiment and therefore a detailed description is omitted here.

Note that the head frame 8 may be fixed to the apparatus body frame 22 in the same method as described for the fourth embodiment in which the both ends of the registration roller 5*b* are rotationally retained by the apparatus body frame 22.

Furthermore, positioning pins 37*a*, 37*b* and 37*c* are fixed to, and projected downward from, the bottom surface of the head frame 8. These positioning pins 37*a*, 37*b* and 37*c* are installed at the positions opposite the positioning holes featured in the drum frame 64 which retains the both shaft ends of the transport drum 63, and the head frame 8 is positioned vis-à-vis the transport drum 63 by the positioning pins 37*a*, 37*b* and 37*c* respectively fitting.

Note that the configuration shown by FIG. 20 places the positioning pins 37*a*, 37*b* and 37*c* for the purpose of positioning the head frame 8 and the transport drum 63, an alternative configuration may place two positioning pins 37*a* and 37*b* on both sides on the axis of the transport drum 63 for positioning them thereby.

According to the invention, since the paper transport configuration adopts the transport drum system, there is no need to maintain flatness as with the transport method by a belt platen, hence making it possible to secure a strength and accuracy of the paper transport unit.

Therefore, it is possible to improve an accuracy of the transport mechanism in addition to reducing a distortion of the head frame 8 by the three-point support method therefore, maintaining a transport accuracy of a cut sheet 3 vis-à-vis the ink heads 24*k*, 24*c*, 24*m* and 24*y*, hence enabling a provision of a high image quality image forming apparatus.

Incidentally, each of the above described first through fifth embodiments uses a cut sheet as the paper, the paper may use a continuous paper for example, however, in lieu of being limited by the cut sheet. In such a case, a transport drum is preferred as the transport mechanism.

Meanwhile, each of the above described first through fifth embodiments describes the case of the head frame 8 placing four line heads thereon as four-color ink heads 24*k*, 24*c*, 24*m* and 24*y*, the ink heads, however, are not limited by such line heads.

Figure 21:
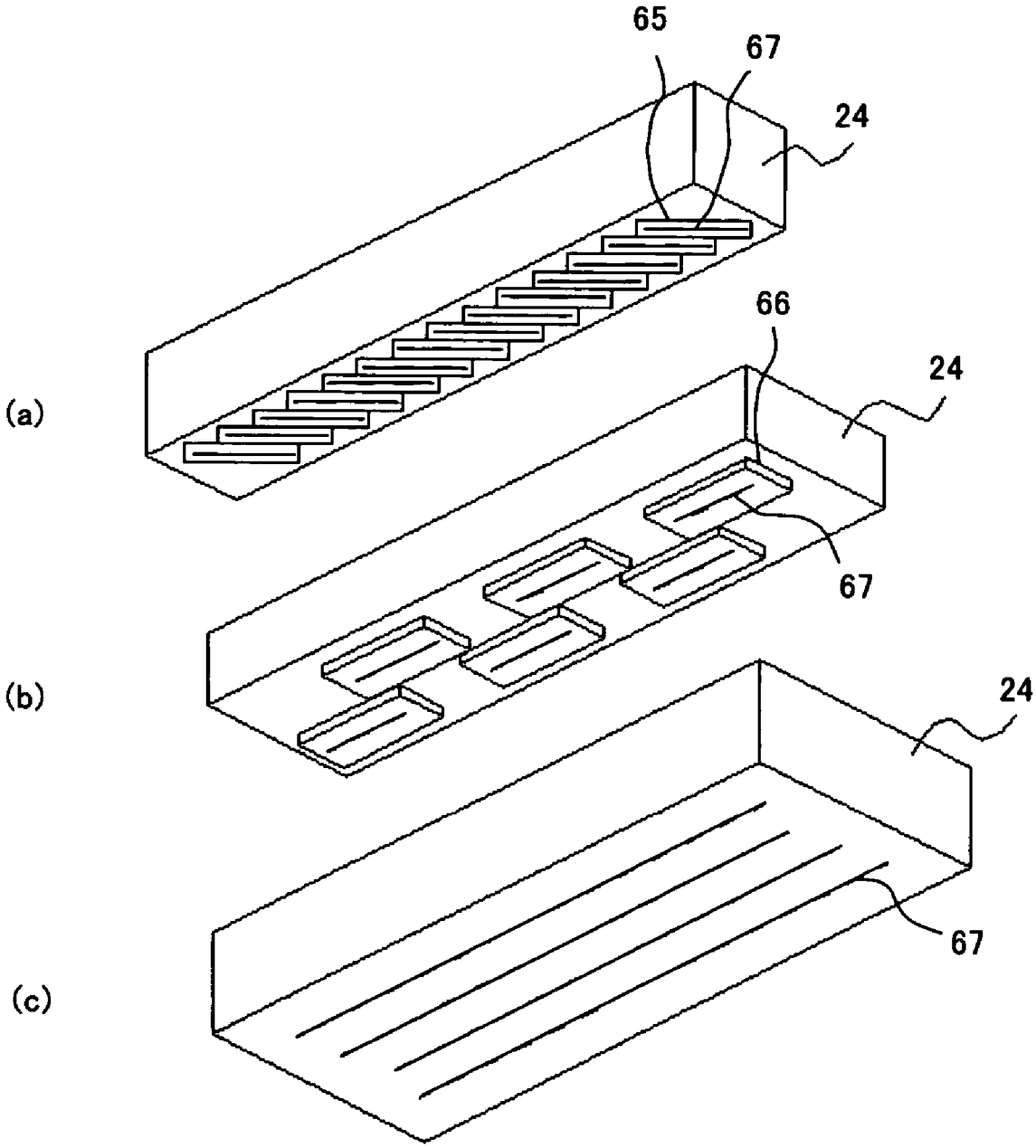
FIG. 21 shows modified examples of head units according to the first through fifth embodiment.

FIG. 21 (*a*), (*b*), (*c*) shows upward diagonal views of three kinds of ink heads 24. Note that FIG. 21 shows the respective nozzle arrays 67 of the ink heads indicated by lines, they are, however, actually an array of very small nozzles closely placed with one another.

The ink head 24 shown by FIG. 21 (*a*) exemplifies a configuration as one ink head 24 by arraying ink heads with a small number of ink ejection nozzles, i.e., a plurality of short length small ink heads 65, diagonally to the transport direction of a recording medium.

And the ink head 24 shown by FIG. 21 (*b*) exemplifies a configuration as one ink head 24 by combining a plurality of a little longer medium sized ink heads 66 in zigzag.

Furthermore, a configuration maybe such that four columns of nozzle arrays 67 are featured in the ink ejection face of one ink head 24 as the one shown by FIG. 21 (*c*) so as to eject the respectively different color inks, that is, four color inks, i.e., magenta, cyan, yellow and black.

As described above, a single ink head may be configured by integrating multiple color ink heads in lieu of one ink head 24 ejecting a single color. The number of colors may be a multiple colors such as the six or more in lieu of the four. The number of color may be one, alternatively.

In any event, the case of configuring to eject a plurality of color inks from a single ink head 24, or that of configuring to eject a single color ink, makes the number of ink head 24 being installed in the head frame 8 one.

What is claimed is:

1. A positioning structure of an image forming apparatus, comprising:

an ink head unit for ejecting ink fluids onto an image recording medium;

a transport mechanism for transporting the image recording medium;

a recording unit for retaining the ink head unit and also positioning itself opposite the transport mechanism; and an apparatus body frame for retaining at least the recording unit and the transport mechanism;

wherein the recording unit is retained by the apparatus body frame at only three portions.

2. The positioning structure of an image forming apparatus according to claim 1, further comprising a restrict unit which comprises a surface of the transport mechanism opposite said recording unit for restricting a positional interrelationship between the recording unit and the transport mechanism.

3. The positioning structure of an image forming apparatus according to claim 1, further comprising a restrict unit which comprises a shaft and a shaft receiving hole for restricting a positional interrelationship between the recording unit and the transport mechanism.

4. The positioning structure of an image forming apparatus according to claim 1, further comprising a transport roller which is retained by said recording unit and which introduces the image recording medium to the transport mechanism by regulating a transport position of the image recording medium.

5. The positioning structure of an image forming apparatus according to claim 1, wherein at least one of said three portions of said recording unit is in freely slidable contact with said apparatus body frame.

6. The positioning structure of an image forming apparatus according to claim 1, wherein said ink head unit comprises a line form ink head.

7. The positioning structure of an image forming apparatus according to claim 6, wherein said ink head unit comprises a plurality of line form ink heads placed in parallel and at a predetermined interval.

8. The positioning structure of an image forming apparatus according to claim 1, wherein said transport mechanism is a belt platen.

* * * * *